US006932209B2

(12) United States Patent
Kasagami et al.

(10) Patent No.: US 6,932,209 B2
(45) Date of Patent: Aug. 23, 2005

(54) TRANSFER DEVICE, TRANSFER DEVICE ASSEMBLY, AND ACCOMMODATING DEVICE THEREOF

(75) Inventors: Fumio Kasagami, Osaka (JP); Fumio Hojo, Osaka (JP)

(73) Assignee: Daihen Corporation, Osaka (JP)

( * ) Notice: Subject to any disclaimer, the term of this patent is extended or adjusted under 35 U.S.C. 154(b) by 26 days.

(21) Appl. No.: 10/400,786

(22) Filed: Mar. 27, 2003

(65) Prior Publication Data

US 2003/0182723 A1 Oct. 2, 2003

(30) Foreign Application Priority Data

Mar. 29, 2002 (JP) ..... 2002-097239

(51) Int. Cl.[7] ..... A61G 7/10

(52) U.S. Cl. ..... 198/312; 198/318; 198/321; 5/81.1 C

(58) Field of Search ..... 198/300, 312, 198/318; 5/81.1 C, 81.1 R

(56) References Cited

U.S. PATENT DOCUMENTS 3,493,979 A * 2/1970 Crook, Jr. et al. ..... 5/81.1 C
3,854,152 A 12/1974 Chez
4,077,073 A * 3/1978 Koll et al. ..... 5/81.1 C
5,540,321 A * 7/1996 Foster ..... 198/510.1
5,850,642 A * 12/1998 Foster ..... 5/81.1 C
6,698,041 B2 * 3/2004 VanSteenburg et al. .... 5/81.1 R
2001/0047543 A1 12/2001 VanSteenberg et al.

FOREIGN PATENT DOCUMENTS

JP 10-033593 2/1998
JP 2001-104378 4/2001

* cited by examiner

*Primary Examiner*—Eileen D. Lillis
*Assistant Examiner*—Mark A. Deuble
(74) *Attorney, Agent, or Firm*—Hamre, Schumann, Mueller & Larson, P.C.

(57) ABSTRACT

A transfer device includes an upper mechanism and a lower mechanism associated with the upper mechanism. The upper mechanism includes a first endless belt that circulates in forward and reverse directions. The lower mechanism includes a second endless belt that circulates in forward and reverse directions independently of the first endless belt. The first and the second endless belts are selectively brought into and out of engagement with each other.

9 Claims, 33 Drawing Sheets

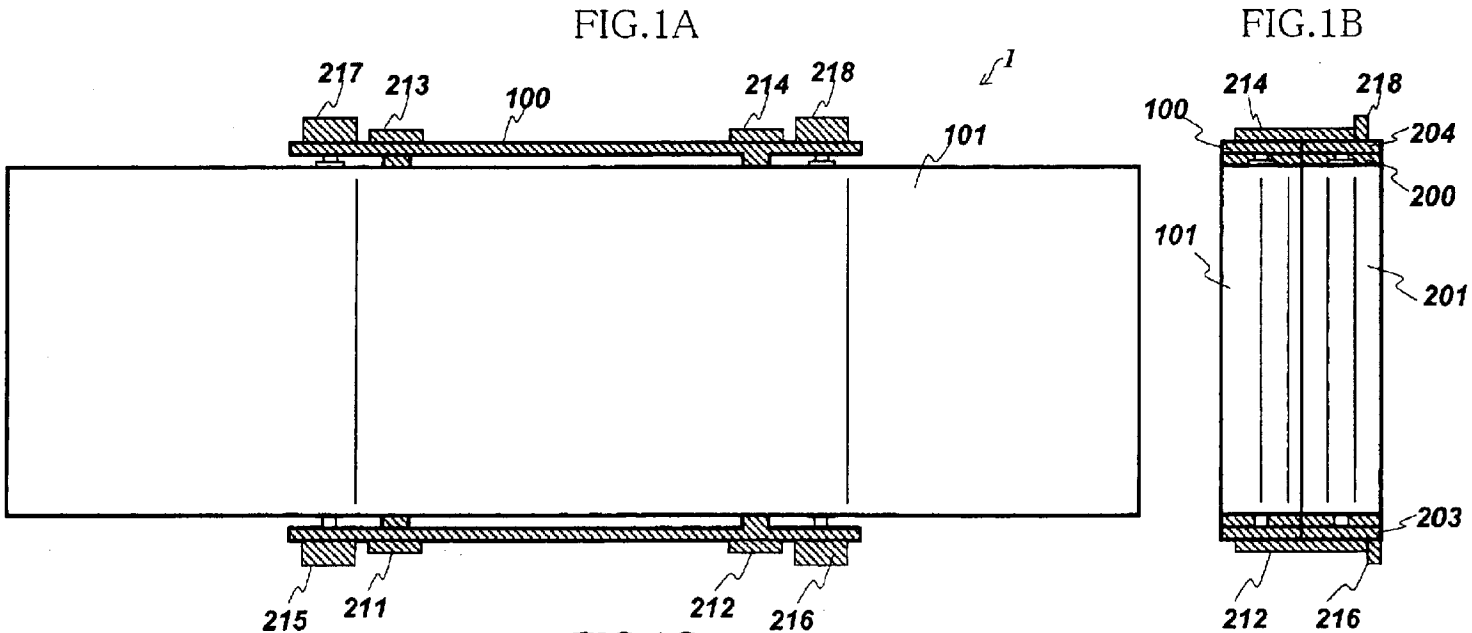
FIG.1A
1
101
218
214
100
213
217
216
212
211
215
FIG.1B
204
200
201
203
218
214
100
101
216
212
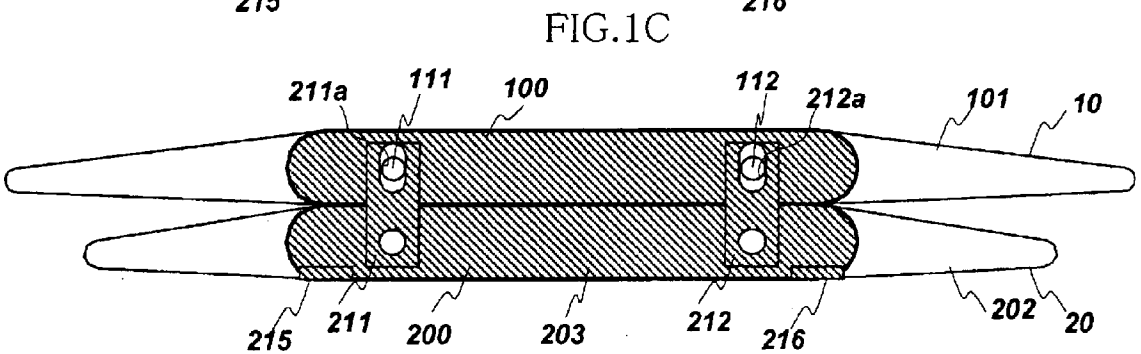
FIG.1C
10
101
212a
112
100
111
211a
20
202
216
212
203
200
211
215

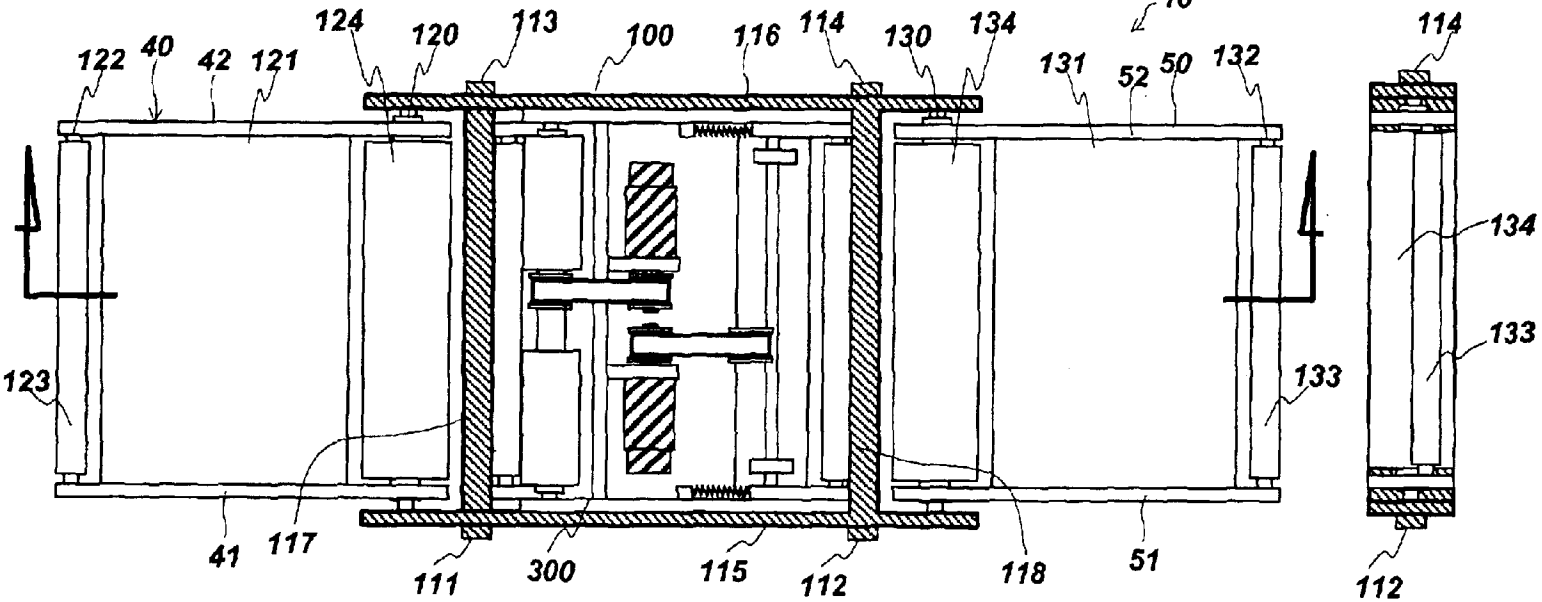
FIG.2B
114
134
133
112
FIG.2A
10
132
50
52
131
134
130
114
116
100
113
120
124
121
42
40
122
123
133
51
118
112
115
300
111
117
41
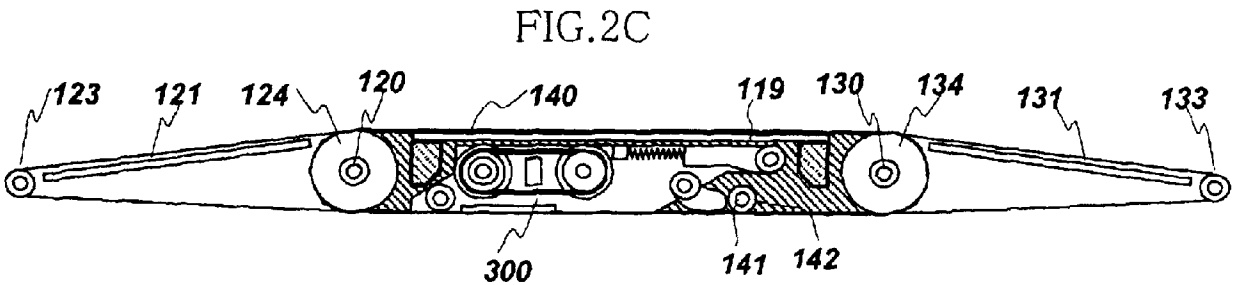
FIG.2C
133
131
134
130
119
140
120
124
121
123
142
141
300

TRANSFER DEVICE, TRANSFER DEVICE ASSEMBLY, AND ACCOMMODATING DEVICE THEREOF

BACKGROUND OF THE INVENTION

1. Field of the Invention

The present invention relates to a transfer device, transfer device assembly and accommodating device thereof suitable for use in transferring patients between beds and stretchers, for example.

2. Description of the Related Art

For transferring patients who are in a condition in which they cannot walk or in a condition in which walking is difficult within a hospital, a transfer platform called a stretcher is employed. A stretcher is constituted by a loading platform having sufficient width and length required for carrying a patient, that is supported on the feet fitted with castors, at practically the same height as the surface of a bed. The stretcher is brought up next to the bed and the patient is transferred between the bed and the stretcher.

This transfer of a patient is usually performed by lifting the patient by a plurality of persons pulling up the edges of the sheet. However, this task is heavy work and requires considerable manpower. Furthermore, the task must be carried out very carefully when transferring a patient fitted up with medical equipment such as a drip device. For these reasons, the task of transferring a patient between bed and stretcher is very difficult.

Various transfer devices have been proposed utilizing mechanical or electric power to perform patient transfer in order to alleviate the above problems.

For example, in Japanese Patent Application Laid-open No. 2001-104378, there is proposed a transfer device whereby the patient is raised by inserting a loading plate by means of a device having a mechanism similar to that of a forklift between the patient and the surface of the bed and the patient on the loading plate is transferred onto a stretcher by reversing direction.

Also, in Japanese Patent Application Laid-open No. H10-33593, there is proposed a transfer device of a construction in which a loading plate which allows selection of a condition extended on the bed and a condition extended on the stretcher by means of a rack and pinion mechanism or the like is provided on a support pillar that is positioned between the bed and the stretcher and in which a belt is wound around the loading plate. The loading plate can be inserted between the bed surface and the patient without relative movement between the belt surface and the patient, when the loading plate is moved in the direction such as to extend over the bed, by shifting the belt in the opposite direction thereto at twice the speed of this movement. A patient who is carried on the loading plate in this way is transferred onto the stretcher by the loading plate moving in the direction to extend over the stretcher. During this process, the belt is driven such that the relative movement between the belt and the moving loading plate is zero. Next, the loading plate is again moved in the direction extending over the bed surface and the belt is shifted in the opposite direction with twice the speed of movement of the loading plate. In this way, the loading plate can be removed from between the patient and the stretcher without relative movement between the belt and the patient, so that transfer of the patient from the bed to the stretcher is completed. Transfer of the patient from the stretcher to the bed can be performed by the opposite procedure to that described above.

However, with the transfer device similar to a forklift that is proposed in the above Japanese Patent Application Laid-open No. 2001-104378, since large power is required in order to raise the patient's weight and relative movement is produced between the loading plate and the patient when the loading plate is inserted between the patient and the bed or when it is removed from between the patient and the stretcher, concern regarding safety is necessary to prevent inadvertent accidents such as dropping of the patient. Also, the direction must be changed with the patient lying on the loading plate and a wide space must be secured in order to ensure correct operation.

Also, it would appear that the transfer device proposed in the above Japanese Patent Application Laid-open No. H10-33593 is superior to the transfer device proposed in the above Japanese Patent Application Laid-open No. 2001-104378 in that relative movement between the patient and the belt is eliminated when the loading belt is inserted between the patient and the bed or when the loading belt is removed from between the patient and the stretcher. However, the belt is slid around the periphery of the loading plate, and relative movement of twice the speed of insertion of the loading plate between the bed and the belt is generated when the loading plate is inserted between the patient and the bed. There is therefore the problem that a large power source is required because the loading plate and the belt must be driven against the resistance between the loading plate and the belt and against the resistance between the belt and the bed surface.

SUMMARY OF THE INVENTION

The present invention has been proposed under the circumstances described above. It is, therefore, an object of the present invention to provide a transfer device capable of operation by small power without requiring a great deal of space for operation and capable of transferring a patient with safety.

According to a first aspect of the present invention, there is provided a transfer device comprising an upper mechanism and a lower mechanism associated with the upper mechanism. The upper mechanism includes a first endless belt that circulates in forward and reverse directions, while the lower mechanism includes a second endless belt that circulates in forward and reverse directions independently of the first endless belt.

Preferably, each of the first and the second mechanisms may comprise: a frame; a first main roller rotatably supported by the frame; a second main roller rotatably supported by the frame and spaced away from the first main roller; a first arm pivotably supported by the frame; a second arm pivotably supported by the frame and positioned opposite to the first arm; a first auxiliary roller rotatably supported by an end of the first arm; and a second auxiliary roller rotatably supported by an end of the second arm. The endless belt circulates in engagement with the first main roller, the second main roller, the first auxiliary roller and the second auxiliary roller.

Preferably, the first and the second auxiliary rollers may be smaller in diameter than the first and the second main rollers.

Preferably, the first and the second arms in the upper mechanism may be longer than the first and the second arms in the lower mechanism.

Preferably, the transfer device of the present invention may further comprise a drive motor to cause the endless belt to circulate and a drive roller driven by the drive motor, wherein the drive roller is held in engagement with the endless belt.

Preferably, the transfer device may further comprise a tension roller biased in a prescribed direction and held in engagement with the endless belt.

Preferably, a part of the endless belt may be pulled into the frame, and the pulled-in part is held in engagement with the drive roller and the tension roller.

Preferably, the transfer device of the present invention may further comprise an attachment/detachment mechanism for selectively bringing the first and the second endless belts into engagement with each other.

Preferably, the attachment/detachment mechanism may comprise a pivotable cam and a cam-receiving member that the cam abuts. The cam is provided on one of the upper and the lower mechanisms, while the cam-receiving member is provided on the other of the upper and the lower mechanisms.

Preferably, the frame may be provided with a linking member for linking with another transfer device.

According to a second aspect of the present invention, there is provided a transfer device assembly comprising a plurality of transfer devices linking with each other, each of the transfer devices including an upper mechanism and a lower mechanism associated with the upper mechanism. The upper mechanism includes a first endless belt that circulates in forward and reverse directions, while the lower mechanism includes a second endless belt that circulates in forward and reverse directions independently of the first endless belt.

According to a third aspect of the present invention, there is provided an accommodating device for a transfer device assembly. The accommodating device comprises an inner space for accommodating the transfer device assembly and an operation contrivance for bringing the assembly into and out of the inner space.

Preferably, the operation contrivance may comprise a first lifting mechanism for moving the transfer device assembly out of the inner space, and a second lifting mechanism for moving the transfer device assembly into the inner space.

Preferably, the transfer device assembly may comprise a plurality of individual transfer devices each of which includes an upper mechanism and a lower mechanism associated with the upper mechanism. The upper mechanism includes a first endless belt that circulates in forward and reverse directions, while the lower mechanism includes a second endless belt that circulates in forward and reverse directions independently of the first endless belt.

Other features and advantages of the present invention will become apparent from the detailed description given below with reference to the accompanying drawings.

BRIEF DESCRIPTION OF THE DRAWINGS

FIG. 1 show the external appearance of a transfer device according to the present invention, where FIG. 1A is a plan view, FIG. 1B is a front view and FIG. 1C is a side view of the transfer device;

FIG. 2 show the condition of the transfer device of the present invention, with a belt and some of the components removed, where FIG. 2A is a plan view, FIG. 2B is a front view and FIG. 2C is a central longitudinal cross-sectional view;

FIG. 34 show a modified example of the transfer device assembly of FIG. 20, where

DETAILED DESCRIPTION OF THE PREFERRED EMBODIMENTS

Preferred embodiments of the present invention will be described below with reference to the accompanying drawings.

Figure 3:
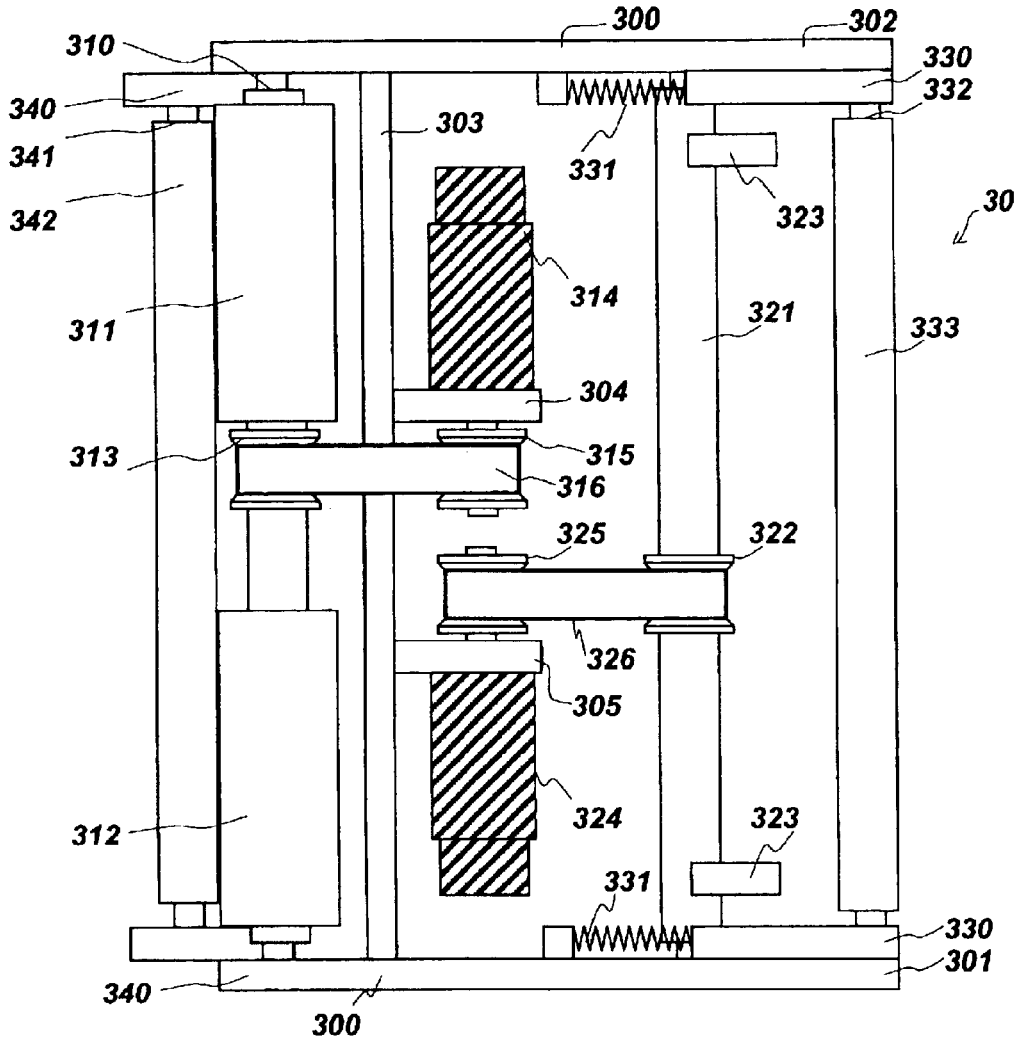
FIG. 3 is a plan view showing the drive section incorporated in the transfer device of the present invention.
Figure 4:
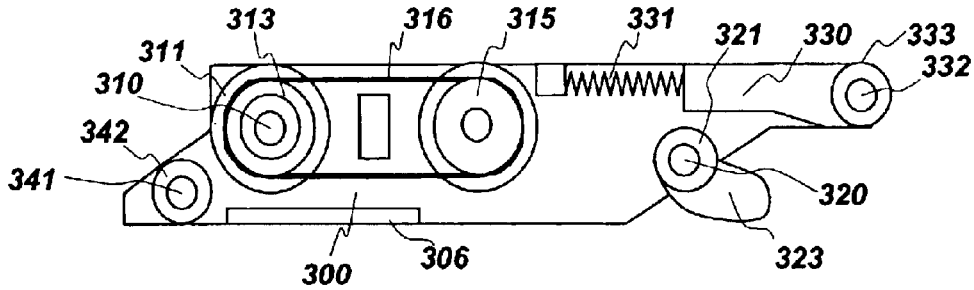
FIG. 4 is a longitudinal cross-sectional view showing the drive section incorporated in the transfer device of the present invention.
Figure 5A:
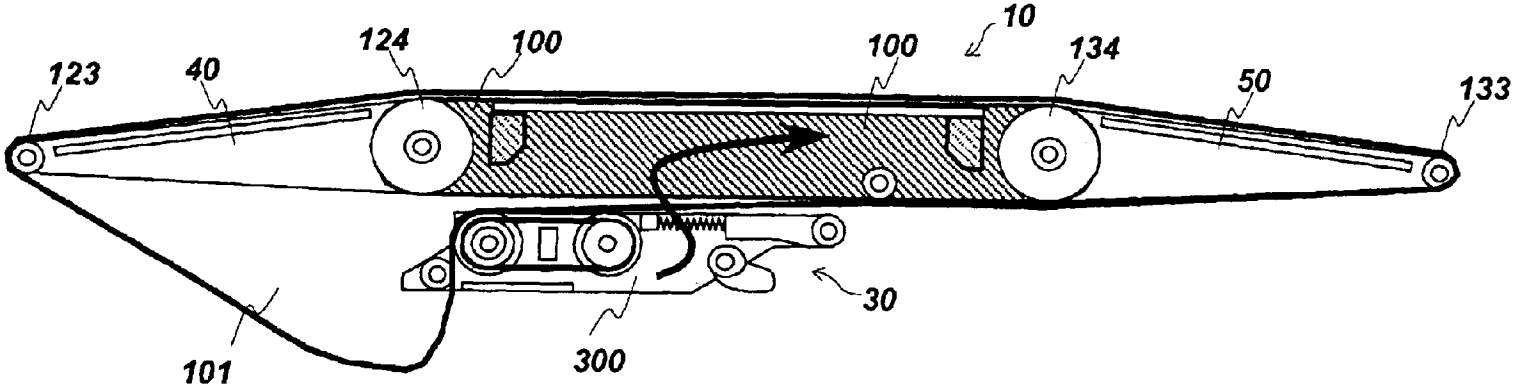
FIGS. 5A and 5B are diagrams illustrating how to incorporate the drive section shown in FIG. 3 and FIG. 4.
Figure 5B:
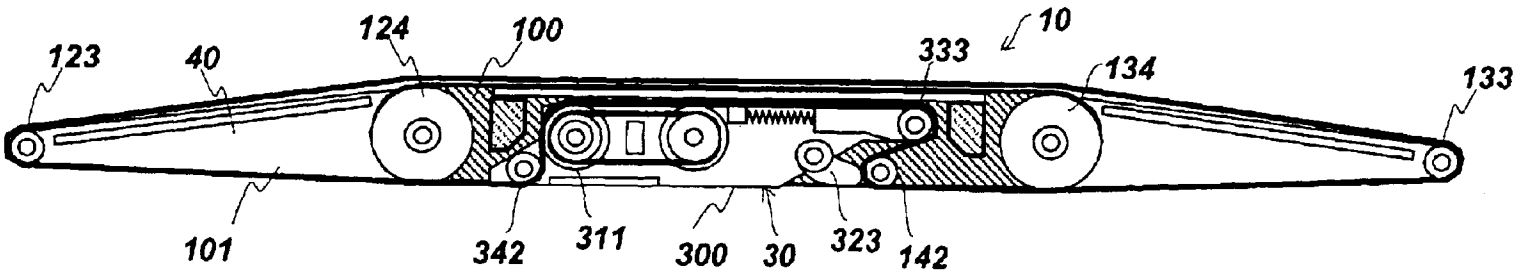
Figure 6A:
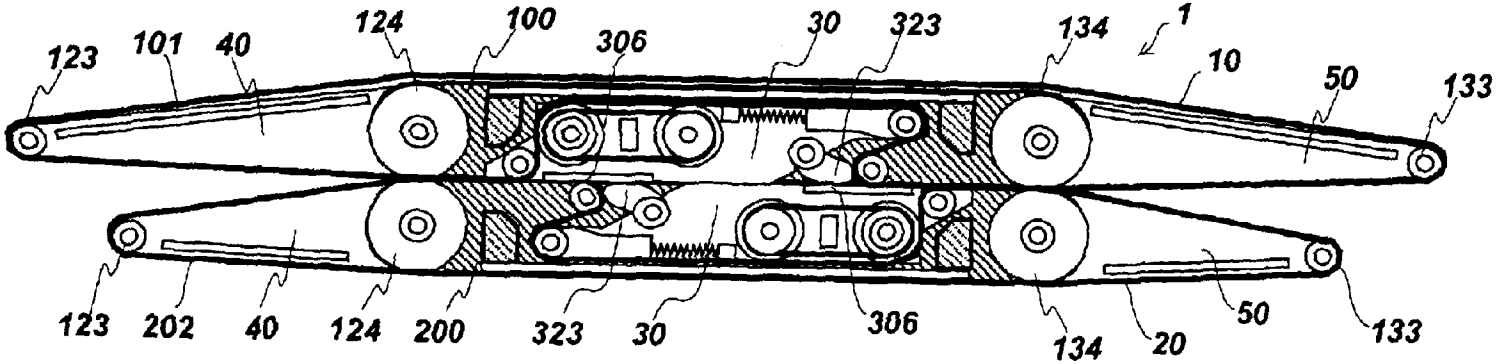
FIGS. 6A and 6B are diagrams illustrating the operation of an attachment/detachment mechanism incorporated in the transfer device of the present invention.
Figure 6B:
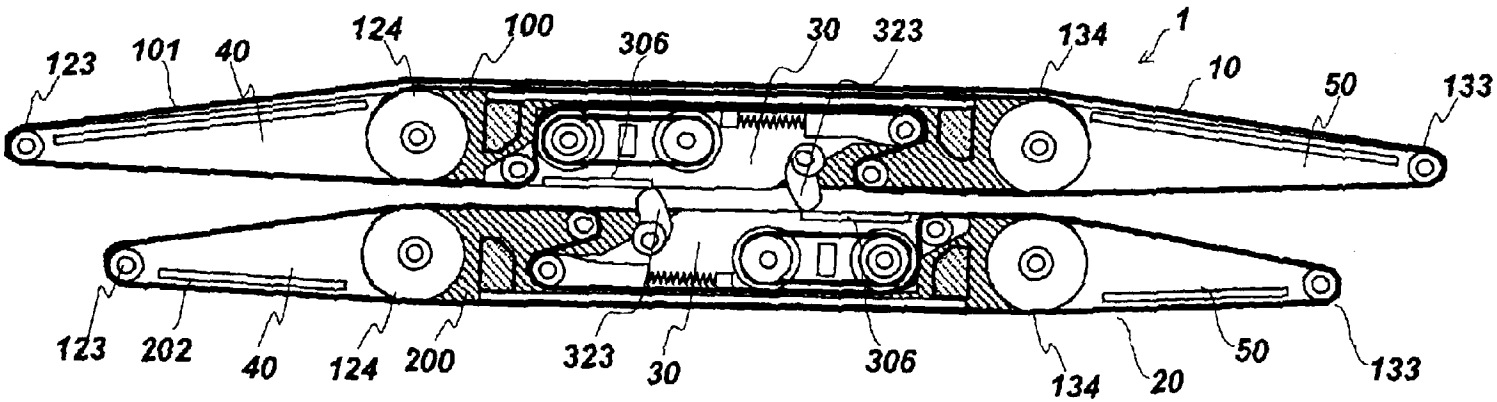
Figure 7:
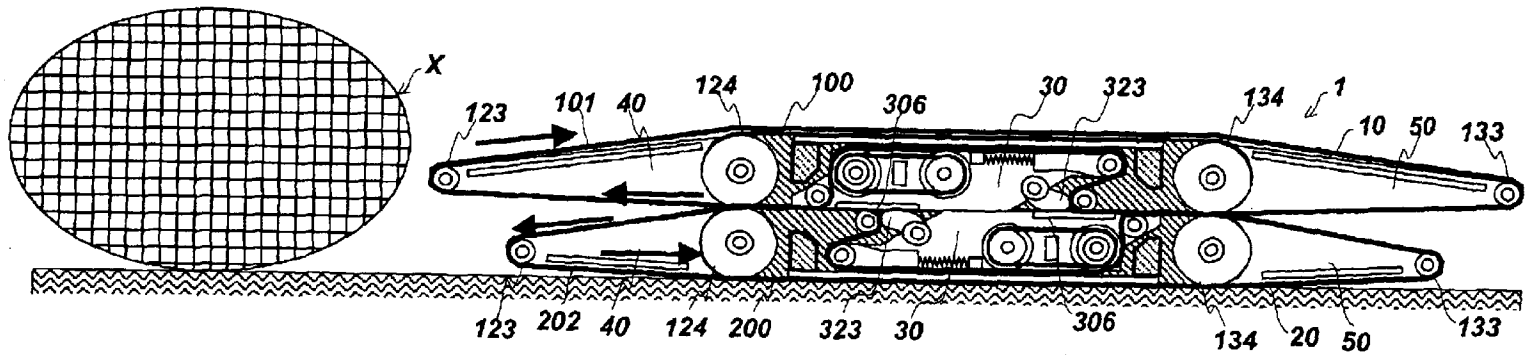
FIGS. 7~19 illustrate the operation of the transfer device of the present invention.

Referring to FIGS. 1 to 6, the basic construction of an embodiment of a transfer device 1 according to the present invention will be described. FIG. 1 show the external appearance of the transfer device 1, where FIG. 1A is a plan view, FIG. 1B a front view and FIG. 1C a side view of the device. As can be seen from these figures, the transfer device 1 is assembled in a configuration in which an upper mechanism 10 and a lower mechanism 20 are superimposed in the vertical direction. FIG. 2 show the condition with the belt of the upper mechanism 10 removed, where FIG. 2A is a plan view, FIG. 2B a front view and FIG. 2C a central longitudinal cross-sectional view. FIG. 3 is a plan view shown with the drive section 30 shown in FIG. 2 extracted. FIG. 4 is a central longitudinal cross-sectional view thereof. Also, FIGS. 5A and 5B show the procedure for mounting the belt of the upper mechanism 10. FIG. 6 are cross-sectional views given in explanation of the assembled condition of the upper mechanism 10 and the lower mechanism 20 of the transfer device 1, where FIG. 6A shows the condition in which the upper mechanism 10 and the lower mechanism 20 are overlaid in contact and FIG. 6B shows the condition in which the upper mechanism 10 and the lower mechanism 20 are separated by a prescribed gap.

As will be understood from FIG. 1C, the upper mechanism 10 and the lower mechanism 20 that constitute the transfer device 1 differ only in regard to the dimensions of the arms 40, 50 on which the belts 101, 202 are wound at both ends of these mechanisms, the remainder being common, so hereinbelow the description will be chiefly focused on the construction of the upper mechanism 10.

As best shown in FIG. 2A, the upper mechanism 10 comprises a frame 100 comprising two side plates 115, 116 that have prescribed vertical dimensions and cross members 117, 118 at two locations in the front/rear direction that extend across between these two side plates. A first main roller 124 and a second main roller 134 are respectively freely rotatably supported about shafts 120, 130 that extent in the frame width direction between the two side plates 115, 116 at both ends of this frame 100. A first arm 40 and a second arm 50 that are capable of swinging about these shafts 120, 130 are respectively linked to both ends of the frame 100.

The first arm 40 and the second arm 50 are provided with two side plates 41, 42, 51, 52 having vertical dimensions equal to the vertical dimensions of the aforementioned two side plates at their root ends but whose vertical dimensions are progressively reduced towards the leading end, and also provided with a first auxiliary roller 123 and second auxiliary roller 133 freely rotatably supported about shafts 122, 132 extending between both side plates at the leading ends of these two side plates. The auxiliary rollers 123, 133 are of smaller diameter than the main rollers 124, 134 and the arms 40, 50 are thereby tapered in side view overall. In the arms 40, 50, back-up plates 121, 131 are provided for supporting the inside surface of the belt 101, to be described, by extending between the vicinities of the upper edges of the two side plates 41, 42, 51, 52.

Also on the frame 100, as shown in FIG. 2C, there is provided a back-up plate 119 for supporting the inside face of the belt 101, to be described, by extending between the vicinities of the upper edges of the two side plates 115, 116. Also, an idler roller 142 is rotatably supported on a shaft 141 extending in the vicinity of the lower edges of the two side plates 115, 116 at a location closer to the second main roller 134.

In this frame 100, a drive section 30 shown in FIG. 3 and FIG. 4 is incorporated constituted separately from this frame. This drive section 30 comprises an auxiliary frame 300 comprising two side plates 301, 302 and a cross member 303 that extends between these two side plates, having overall a vertical dimension smaller than the vertical dimension of the frame 100 and a width dimension equal to that of the dimension between the inside surfaces. At a location that is closer to the first main roller 124 on this auxiliary frame 300, there is fixedly arranged a shaft 310 extending between the two side plates 301, 302 and left and right belt drive rollers 311, 312 are supported so as to be capable of rotation in unitary fashion on this shaft 310. A pulley 313 that rotates in unitary fashion with the belt drive rollers 311, 312 is also supported on this shaft 310. A motor 314 for belt drive is supported by means of a bracket 304 on the cross member 303 and a timing belt 316 extends between the pulley 313 and the pulley 315 mounted on the output shaft of the motor 314. In this way, the belt drive rollers 311, 312 are driven in rotation in the forward and reverse directions by forward/reverse rotation of the belt drive motor 314.

At a location on the auxiliary frame 300 that is closer to the second main roller 134, sliding blocks 330, 330 are provided that are supported in restrained fashion so that they are capable of movement only in the forward/rearwards direction on the inside surface of the two side plates 301, 302, these two sliding blocks being constantly biased outwards i.e. in the direction of the second main roller 134, by means of springs 331, 331. A tensioning roller 333 is freely rotatably supported on a shaft 332 provided in fixed fashion so as to extend between the two sliding blocks 330, 330.

A cylindrical body 321 is freely rotatably fitted onto a shaft 320 that is fixedly provided so as to extend between the two side plates 301, 302 on the auxiliary frame 300 and in the vicinity of the two sliding blocks 330, 330. Two cams 323, 323 that extent downwards are mounted at both ends of this cylindrical body 321. A pulley 322 is fixedly provided in the middle portion of the cylindrical body 321. A pulley 325 is provided on the output shaft of a cam drive motor 324 that is supported by means of a bracket 305 on the cross member 303, a timing belt 326 being extended between this pulley 325 and the pulley 322. In this way, by forward/reverse rotation of the cam drive motor 324, a condition in which the cams 323, 323 project from the bottom edge of the auxiliary frame 300 and a condition in which they do not project can be selected.

Also on the auxiliary frame 300 and in the vicinity of the belt drive rollers 311, 312, there is provided a cam-receiving plate 306 extending between the vicinities of the bottom edges of the two side plates 301, 302. As shown in FIGS. 6A and 6B, the cam 323 and the cam-receiving plate 306, when the upper mechanism 10 and the lower mechanism 20 are assembled, are made to face the counterpart cam-receiving plate 306 and cam 323 of the lower mechanism 20, which has a construction which is the same as that of the upper mechanism 10. Thus, it is possible to make the upper mechanism 10 and lower mechanism 20 assume a condition in which they are mutually overlaid in contact (FIG. 6A) and a condition in which they are mutually separated (FIG. 6B).

Idler rollers 342 are freely rotatably supported by means of releasable brackets 340, 340 with respect to the two side plates 301, 302 in a location outside the cam-receiving plate 306, and in the vicinity of the belt drive rollers 311, 312 on the frame 300. Specifically, a shaft 341 extends fixedly between the brackets 340, 340 and the idler rollers 342 are freely rotatably supported on this shaft 341.

An endless belt 101 can be mounted in the following manner, as the drive section 30 constructed as above is mounted on the frame 100.

Specifically, as shown in FIG. 5A, a condition is created in which part of the belt 101 passes through between the belt drive rollers 311, 312 and the idler rollers 342 by removing the brackets 340 from the auxiliary frame 300. The brackets 340 are then linked with the auxiliary frame 300. Next, the condition shown in FIG. 5B is created by inserting the auxiliary frame 300 of the drive section 30 into the frame 100 as shown by the arrows in FIG. 5A and the auxiliary frame 300 of the drive section 30 is fixed to the frame 100 by means of bolts or the like. In this way, the belt 101 is passed below the first main roller 124, above the first auxiliary roller 123 and first main roller 124, above the second main roller 134 and below the second auxiliary roller 133 and second main roller 134. A location between the two idler rollers 342, 142 is pulled into the frame 100 in the underside of this upper mechanism 10 i.e. in the face opposing the lower mechanism 20. The belt is then passed around the tensioning roller 333 and the belt drive rollers 311, 312. The tensioning roller 333 applies tensile force to whole of the endless belt 101, thereby bringing the belt 101 into stable contact with the belt drive rollers 311, 312. As shown in FIG. 5B, the first arm 40 and the second arm 50 are stable in a horizontal condition, thanks to the tension that is applied in this way to the belt 101. The inside surfaces of the belt 101 at the location running between the first auxiliary roller 123 and first main roller 124, at the location running between the first main roller 124 and second main roller 134, and at the location running between the second main roller 134 and second auxiliary roller 133, are respectively supported by the back-up plates 121, 119, 131 that are respectively provided on the first arm 40, frame 100 and second arm 50. This enables proper support of the weight of a transferred subject on the belt 101.

As described above, the lower mechanism 20 differs from the upper mechanism 10 solely in that the lengths of the first arm 40 and second arm 50 are different. Specifically, the frame 100, drive section 30 and the arrangement of the belt 202 are the same as in the case of the upper mechanism 10. The transfer device 1 is constituted by assembling the upper mechanism 10 with the lower mechanism 20 as shown in FIGS. 6A, 6B, with the lower mechanism arranged as if the upper mechanism are inverted through 180°.

Returning to FIG. 1, linkage plates 211, 212 are mounted on both side plates 203, 204 of the frame 200 of the lower mechanism 20, and long slots 211*a*, 212*a* elongated vertically are formed at locations projecting at the side of the upper mechanism 10 of these linkage plates 211, 212, these slots being engaged by pins 111, 112 that project at the side wall of the upper mechanism 10. In this way, the upper mechanism 10 and lower mechanism 20 can be mutually joined or separated in the range permitted by movement of the pins 111, 112 within the slots 211*a*, 212*a*.

Figure 20:
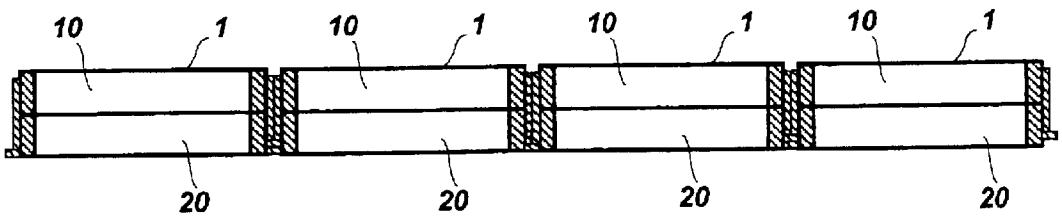
FIG. 20 is a front view showing a transfer device assembly in which a plurality of transfer devices shown in FIG. 1 are linked.
Figure 21:
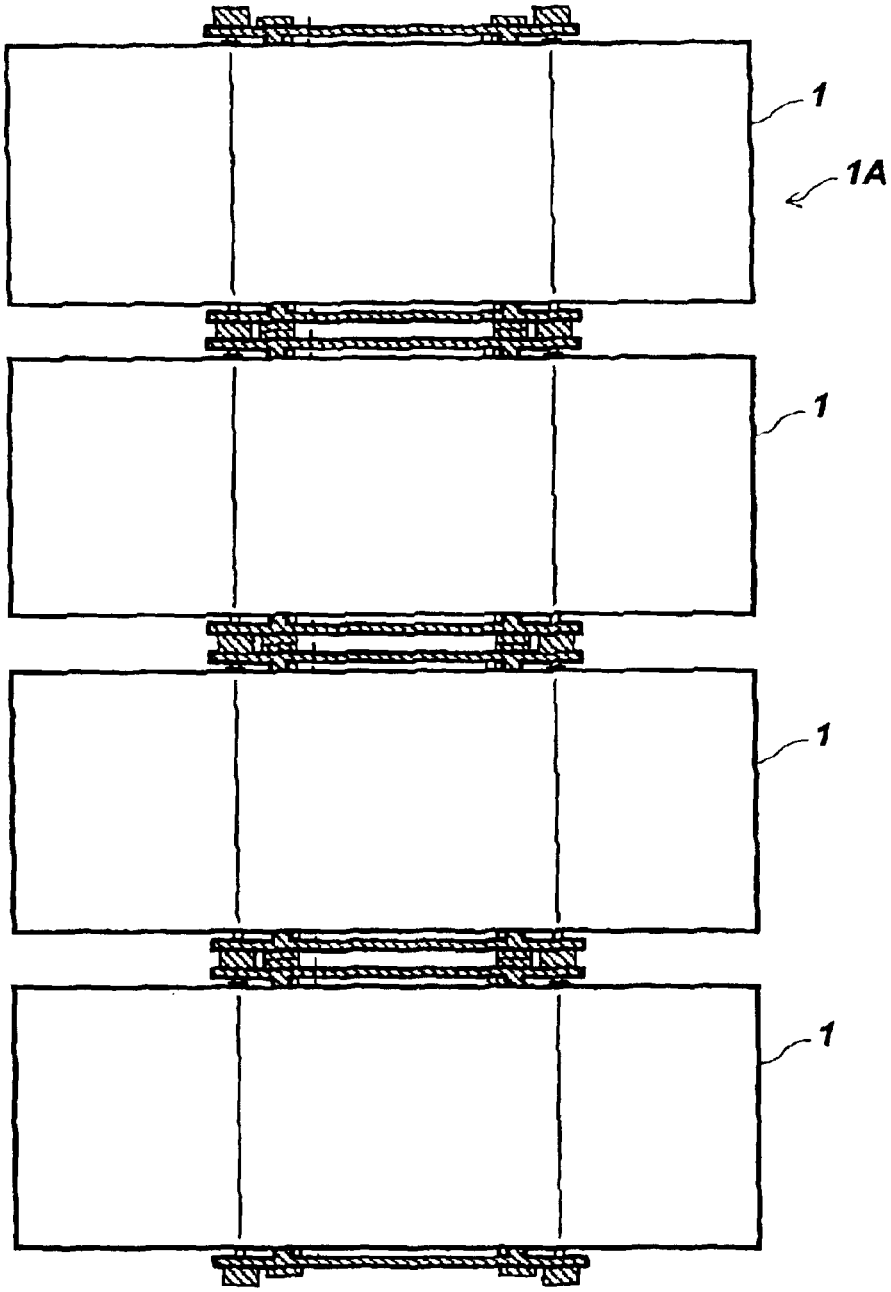
FIG. 21 is a plan view showing the transfer device assembly of FIG. 20.

Also, linkage plates 215, 216, 217 and 218 are provided at two locations each on the two side plates 203, 204 of the frame 200 of the lower mechanism 20, along the bottom edges thereof. That is, the linkage plates 215, 216 provided on one side plate 203 and the linkage plates 217, 218 provided on the other side plate 204 are at mutually different heights; in this way, in a condition in which a plurality of transfer devices 1 are juxtaposed, adjacent transfer devices 1 may be linked up by linking these using bolts or the like between mutually overlapping linkage plates 215, 217 and 216, 218, to produce a transfer device assembly 1A as shown in FIG. 20 and FIG. 21.

Next, the operation of the transfer device 1 will be described with reference to FIG. 7 to FIG. 19.

FIG. 7 to FIG. 11 show the operation up to loading of the subject of transfer X onto the transfer device 1 by moving the transfer device 1 freely underneath the transfer subject X, such as a patient, who is at the location from which transfer is to take place, such as for example a bed. The upper mechanism 10 and lower mechanism 20 constituting the transfer device 1 are overlaid in mutual contact with their respective cams 323 retracted. When the belt drive motors 314 of the two mechanisms 10, 20 are rotated with the same speed in first mutually opposite directions, the belts 101, 202 of the two mechanisms 10, 20 circulate in opposite directions with the same speed. The circulating belt 202 in the lower mechanism 20 acts as a caterpillar track, moving the entire transfer device 1. The two belts 101, 202 are held in contact with each other, with the upper mechanism 10 facing the lower mechanism 20. However, since the two belts are moving with the same speed in the same direction at this location, no relative movement between the two takes place.

Figure 8:
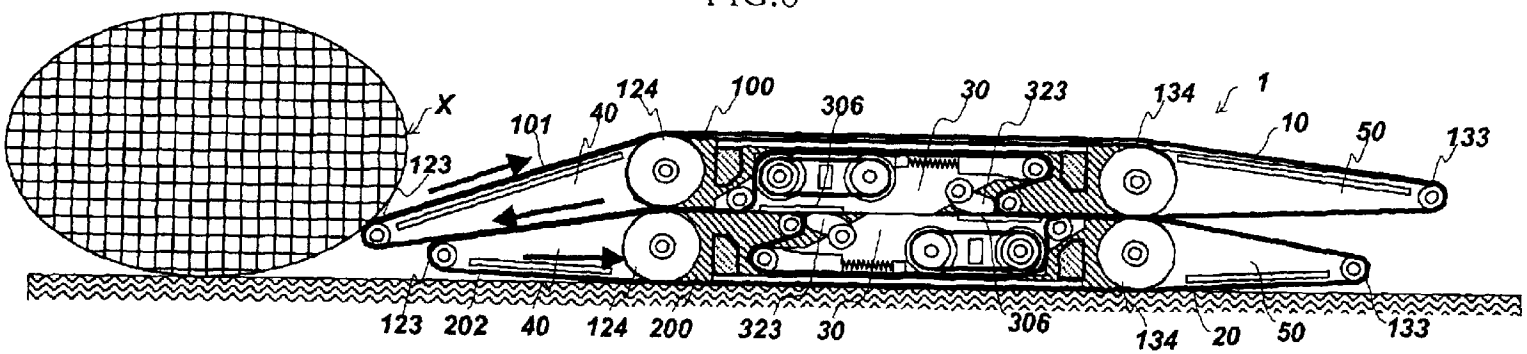

Eventually the leading end of the transfer device 1 comes into contact with the transfer subject X (FIG. 8). In this embodiment, the first arm 40 of the upper mechanism 10 is longer than the first arm 40 of the lower mechanism 20, so the belt 101 that passes over the first auxiliary roller 123 of the upper mechanism 10 will necessarily come into contact with the transfer subject. The running direction of the belt that passes over this first auxiliary roller 123 is upwards as shown in FIG. 8. Consequently, thanks to the belt 101 the first arm 40 swings downwards so that this runs freely over the surface of the transfer subject X, so that the leading end thereof tries to burrow below the transfer subject X. Pushed by this action of the first arm 40 of the upper mechanism 10, the first arm 40 of the lower mechanism 20 also likewise swings downwards (FIG. 9) so that its undersurface contacts the bed surface. In this way, the contact area of the belt 202 of the lower mechanism 20 with the bed surface is increased, increasing the self-running drive force of the transfer device 1.

Figure 9:
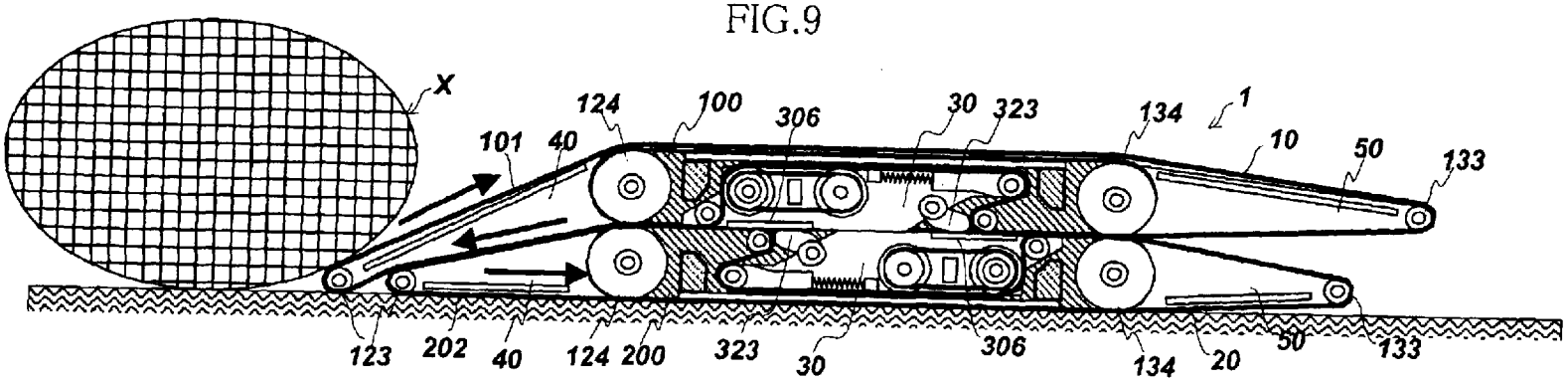
Figure 10:
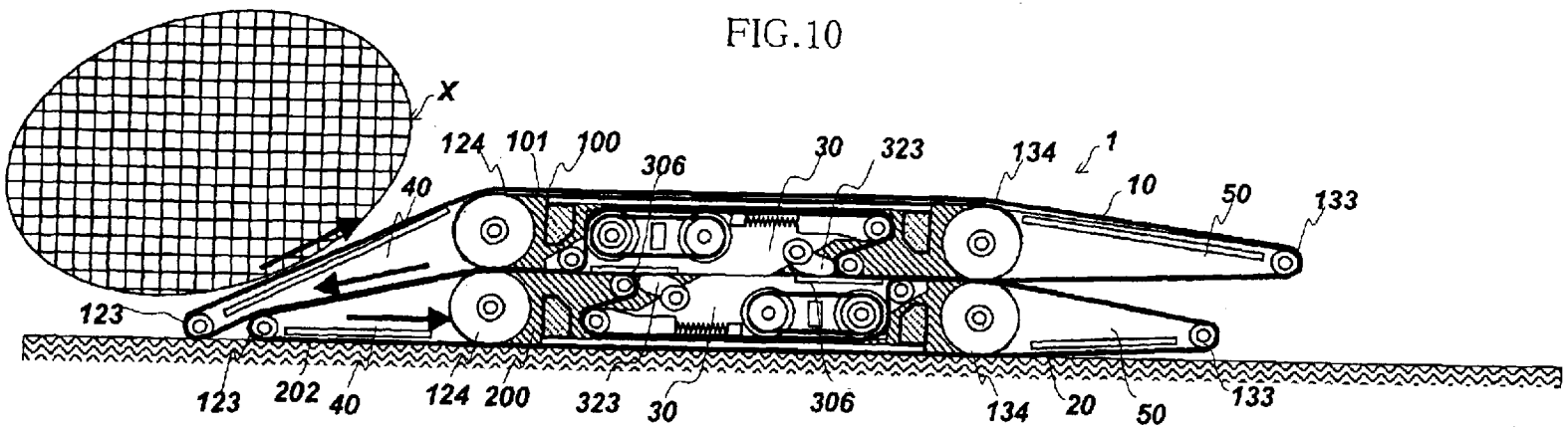

Since the first arm 40 of the upper mechanism 10 is longer than the first arm 40 of the lower mechanism 20, as shown in FIG. 9, the first auxiliary roller 123 of the upper mechanism 10 assumes a more forward position that does not overlie the first auxiliary roller 123 of the lower mechanism 20. Thus, the leading end of the device, reduced in thickness corresponding to the vertical dimensions of the leading end of the first arm 40 of the upper mechanism 10, can easily burrow between the transfer subject X and the bed surface.

Figure 11:
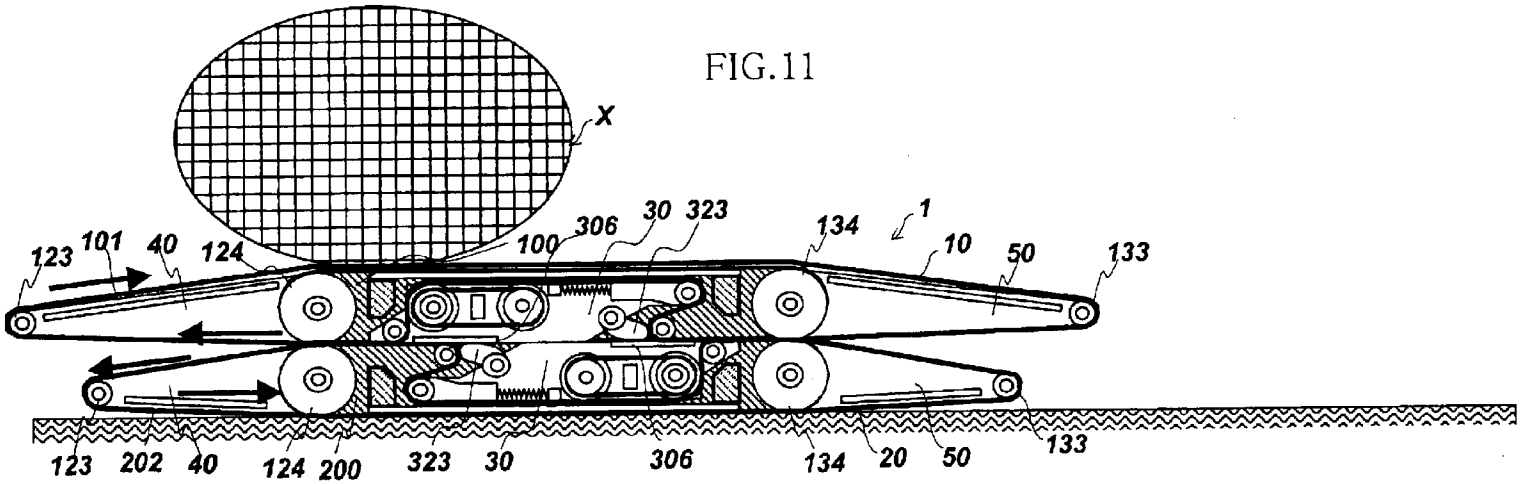

As the transfer device 1 runs further on its own in the same direction, it enters further between the transfer subject X and the bed surface (FIG. 10) by the wedge effect of the two first arms 40. In this process, the belt 101 of the upper mechanism 10 that is in contact with the transfer subject X circulates in the opposite direction with the same speed as the belt 202 of the lower mechanism 20, so there is no relative movement of the contacting portion of the belt 101 of the upper mechanism 10 with the transfer subject X and the bed surface. Consequently, by this means also, the leading end portion of the transfer device 1 can easily penetrate between the subject transfer X and the bed surface and the situation that the transfer device 1 pushes the transfer subject X off the bed so that the transfer subject X accidentally drops off the bed is unlikely to occur. In this way, as shown in FIG. 11, a condition in which the transfer subject X is carried on the upper surface of the transfer device 1 i.e. on the belt 101 of the upper mechanism 10 is obtained.

Figure 12:
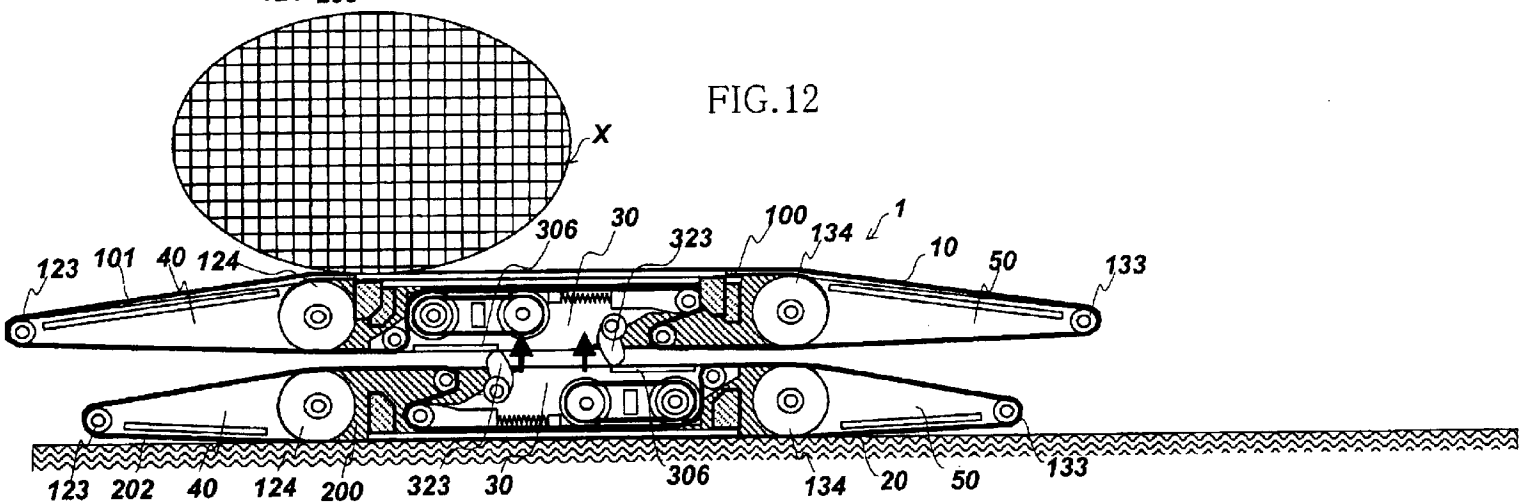
Figure 13:
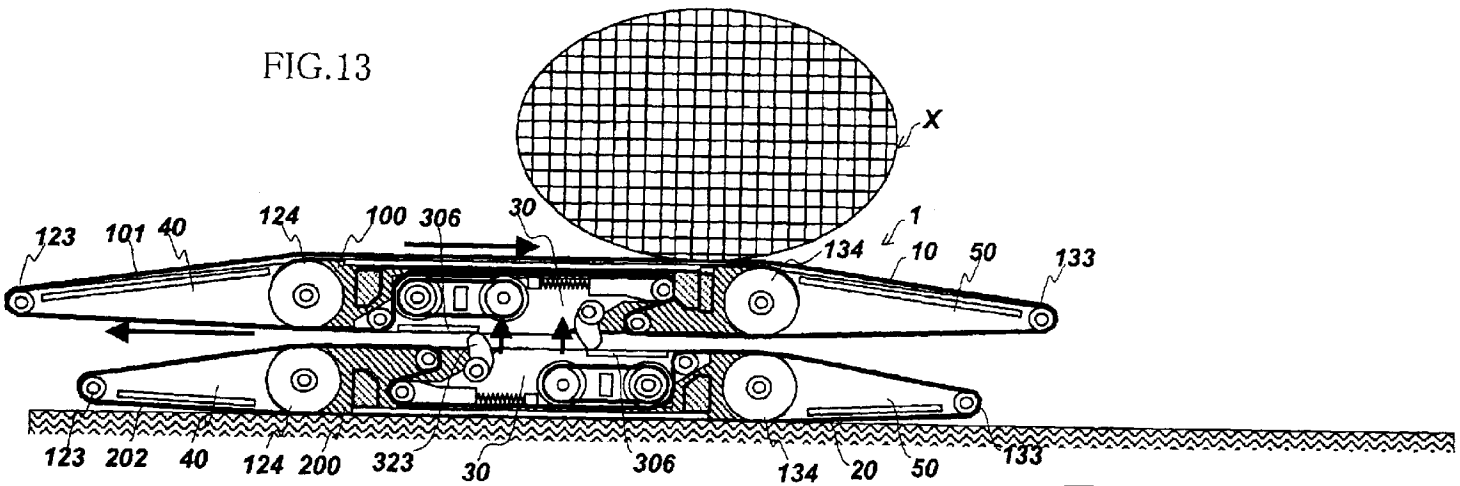

Next, as shown in FIG. 12 and FIG. 13, the cams 323 of the upper mechanism 10 and the lower mechanism 20 are erected, so that both mechanisms assume a separated condition. In this condition, the mutually contacting condition of the belt 101 of the upper mechanism 10 and the belt 202 of the lower mechanism 20 at facing locations of the two mechanisms 10, 20 is eliminated, so separate drive of the belts 101 and 102 becomes possible. Thus, with the belt 202 of the lower mechanism 20 stopped, the belt 101 of the upper mechanism 10 is driven in the first direction, causing the transfer subject X to be shifted from one end of the frame 100 of the upper mechanism 10 to the other end thereof. It should be noted that, at this point, the transfer mechanism 1 is still above the bed where the transfer subject X is placed.

Figure 14:
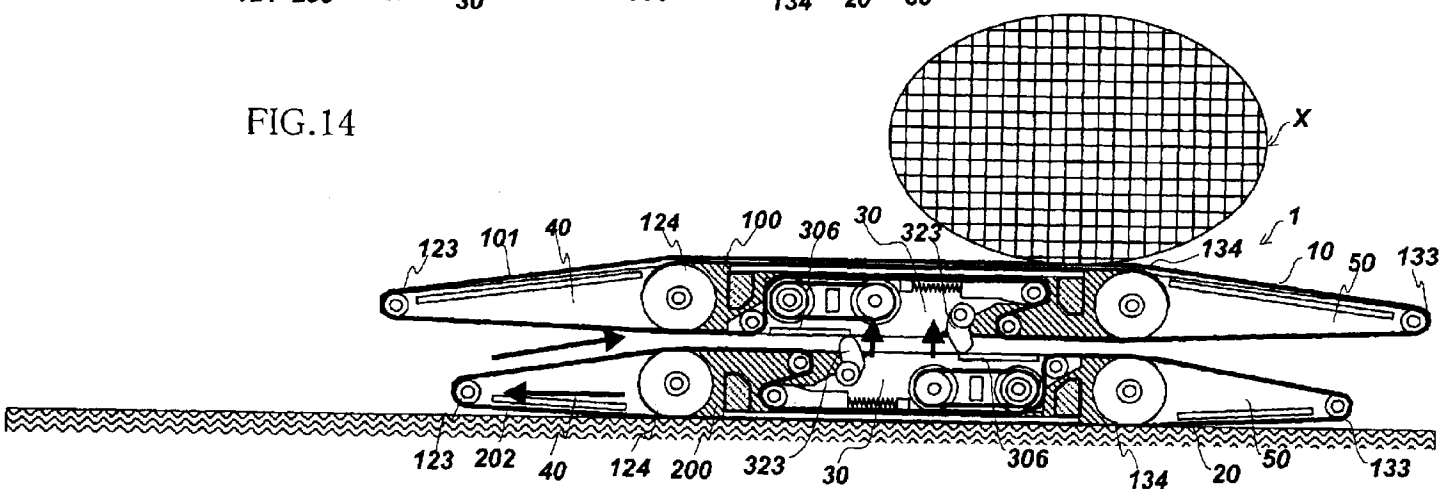
Figure 15:
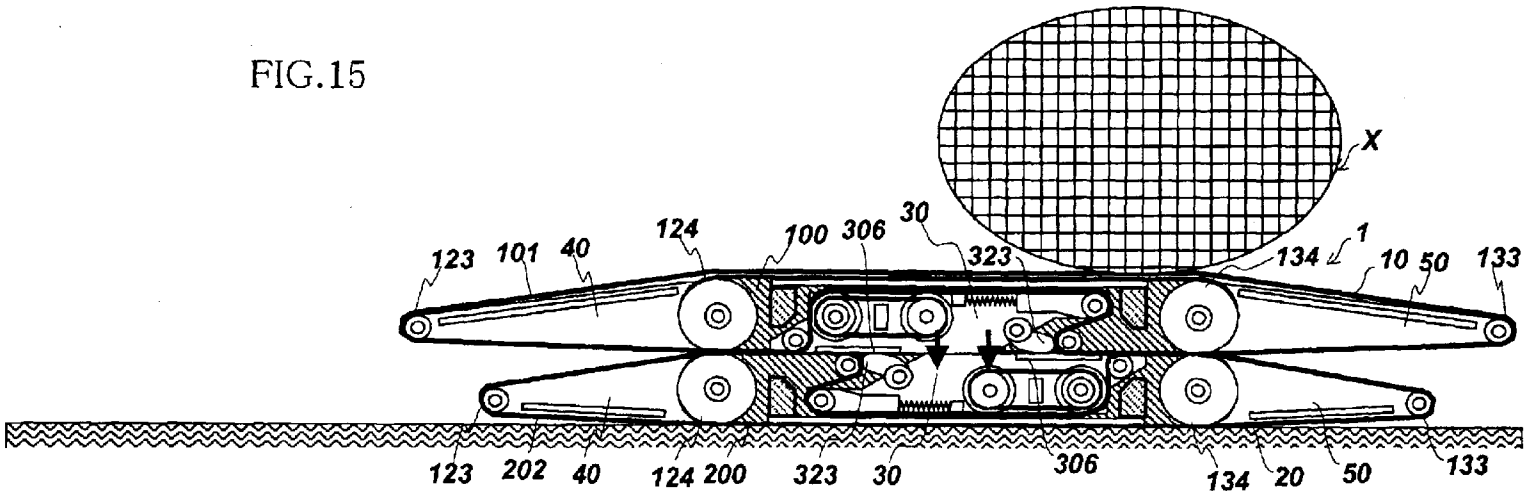
Figure 16:
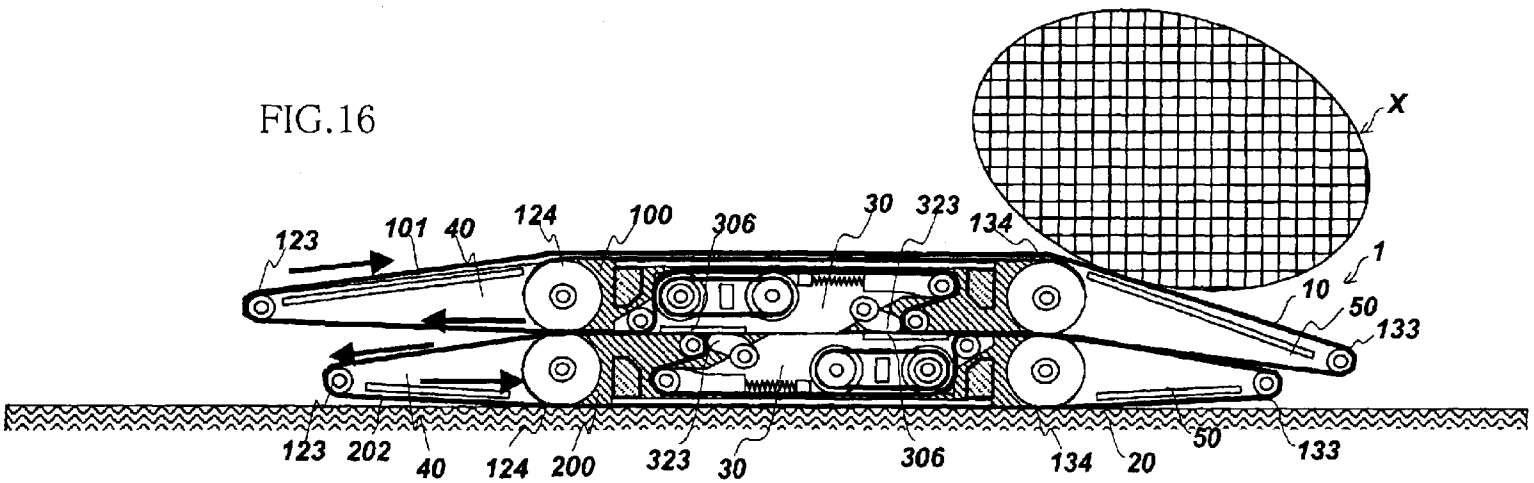

Next, as shown in FIG. 14, with the relatively separated condition of the upper mechanism 10 and the lower mechanism 20 maintained, the belt 101 of the upper mechanism 10 is stopped and the belt 202 of the lower mechanism 20 is driven in the second direction opposite to the above-mentioned direction. The transfer device 1 can thereby be allowed to go, with the transfer subject X carried thereon in a fixed position on its upper surface, to e.g. the transfer destination such as a stretcher. In this way, when the transfer device 1 arrives above the stretcher, drive of the belt 202 of the lower mechanism 20 is stopped and then, as shown in FIG. 15, the two cams 323 of the upper mechanism 10 and lower mechanism 20 are retracted thereby putting these once more in the contacting overlaid condition.

FIG. 16 to FIG. 19 show the operation up to the completion of transfer of the transfer subject X to the destination, after the transfer device 1 has arrived at the transfer destination, such as a stretcher, and moved away from between the transfer subject X and the stretcher.

The belts 101, 202 of the two mechanisms 10, 20 are circulated with the same speed in the mutually opposite second directions. The belt 202 circulating in the lower mechanism 20 acts as a caterpillar track, being made to self-move so as to remove the entire transfer device from the stretcher toward the bed. The belts 101, 202 make contact with each other at the facing location of the upper mechanism 10 and lower mechanism 20 but both belts are moving with the same speed in the same direction locally, so there is no relative movement between the two belts.

Figure 17:
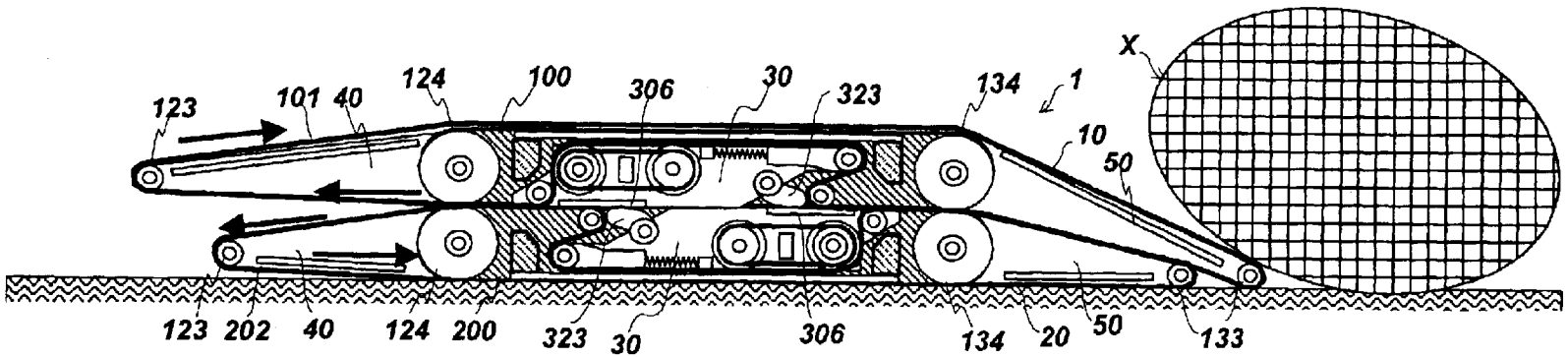
Figure 18:
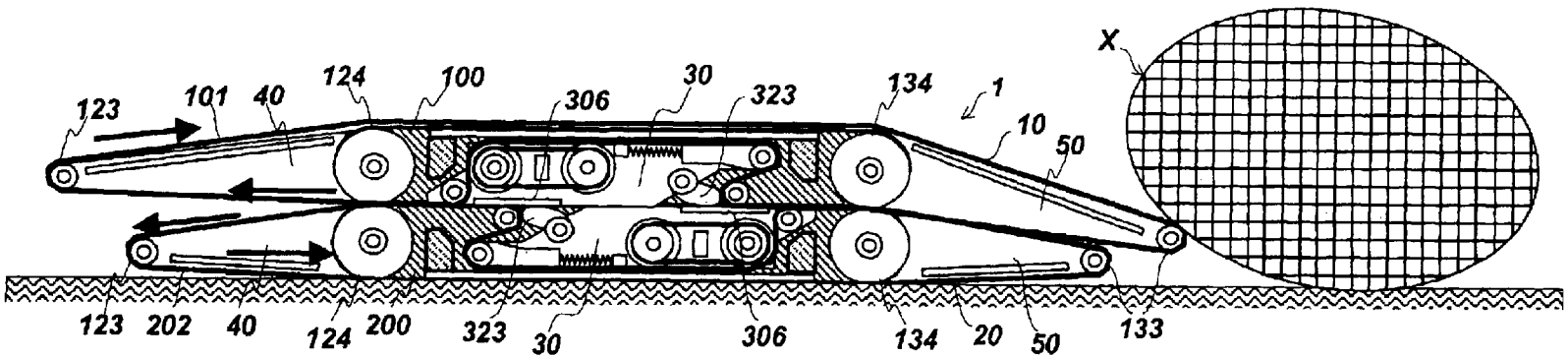
Figure 19:
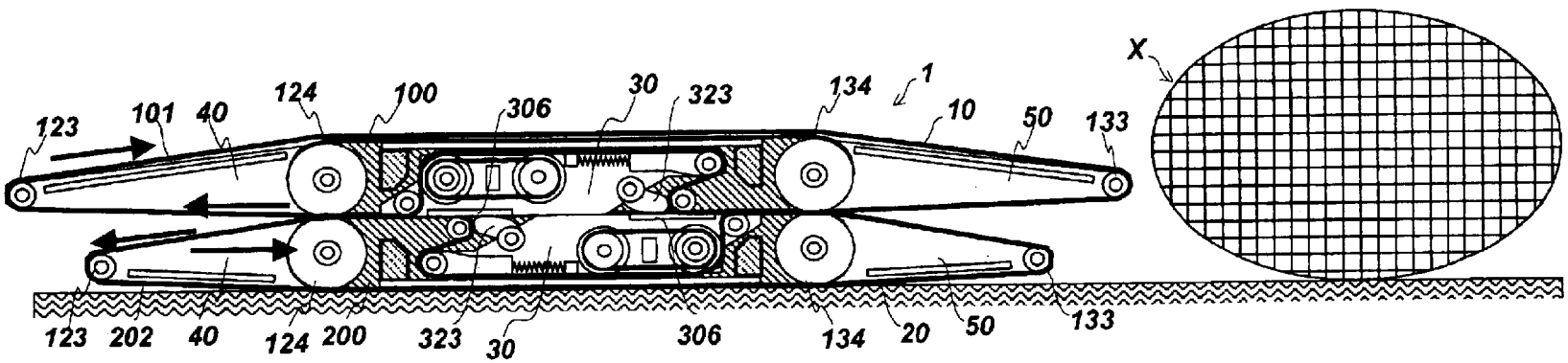

The transfer subject X that is placed on the belt 101 of the upper mechanism 10 is moved relatively over the transfer device 1 following the movement of this belt 101. However, since no relative movement of the belt 101 of this upper mechanism 10 and the stretcher takes place, the transfer subject X is lowered in position onto the stretcher without being moved in planar fashion over the stretcher (FIG. 17). Also, in this process, there is no possibility of the transfer subject X being subjected to external force in the width direction of the stretcher. In this process, as shown in FIG. 17, the second arm 50 of the upper mechanism 10 and the second arm 50 of the lower mechanism 20 are made to mutually overlap by being swung downwards by the weight of the transfer subject X. Also, since the second arm 50 of the upper mechanism 10 is made longer than the second arm 50 of the lower mechanism 20, the second auxiliary roller 133 of the upper mechanism 10 is positioned further on the outside instead of vertically overlying the second auxiliary roller 133 of the lower mechanism 20. The transfer subject X, which is moved by the belt 101 above the second arm 50 of this upper mechanism 10, is therefore transferred smoothly onto the stretcher without being transferred across any particularly marked difference in levels (FIG. 17).

After the transfer subject X has been transferred onto the stretcher, the transfer device 1 moves away (FIG. 18) leaving the transfer subject X on the stretcher. At this point, the second arm 50 of the upper mechanism 10 will return to a horizontal stable condition, with the second auxiliary roller 133 at the leading end thereof and the circulating belt 101 held in contact with the surface of the transfer subject X. In this case also, since the belt 101 is moved without causing relative movement with respect to the surface of the transfer subject X, no frictional resistance is generated, whereby the patient as the transfer subject X does not feel any discomfort.

FIG. 20 and FIG. 21 show a transfer device assembly 1A constituted by linking a plurality of transfer devices 1 in the width direction. When transfer devices 1 are to be employed for transferring a patient between a bed and a stretcher, such a transfer device assembly 1A is constituted, taking the bed length into consideration. When this is done, the transfer devices 1 are made to execute a synchronized action in regard to drive of the belts 101, 102 and drive of the cams 323. Of course, a suitable number of these transfer devices 1 are employed linked up together in accordance with the length of the transfer subject X, or the dimension of the location from which transfer is effected or the dimension of the transfer destination.

FIG. 22 to FIG. 33 diagrammatically show an example of application as a patient transfer device between a bed B and a stretcher S using the transfer device assembly 1A. A brief description of these drawings is given below.

Figure 22:
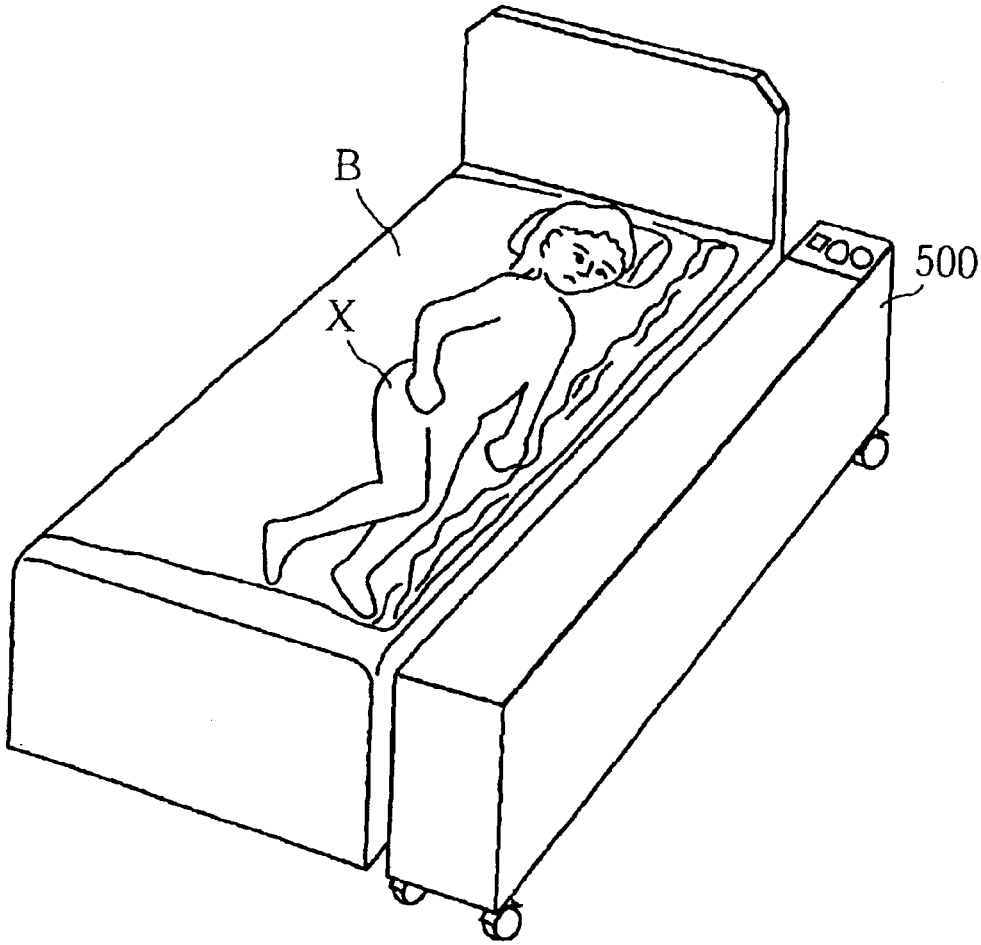
FIGS. 22~33 show how to use the transfer device assembly of FIG. 20.
Figure 23:
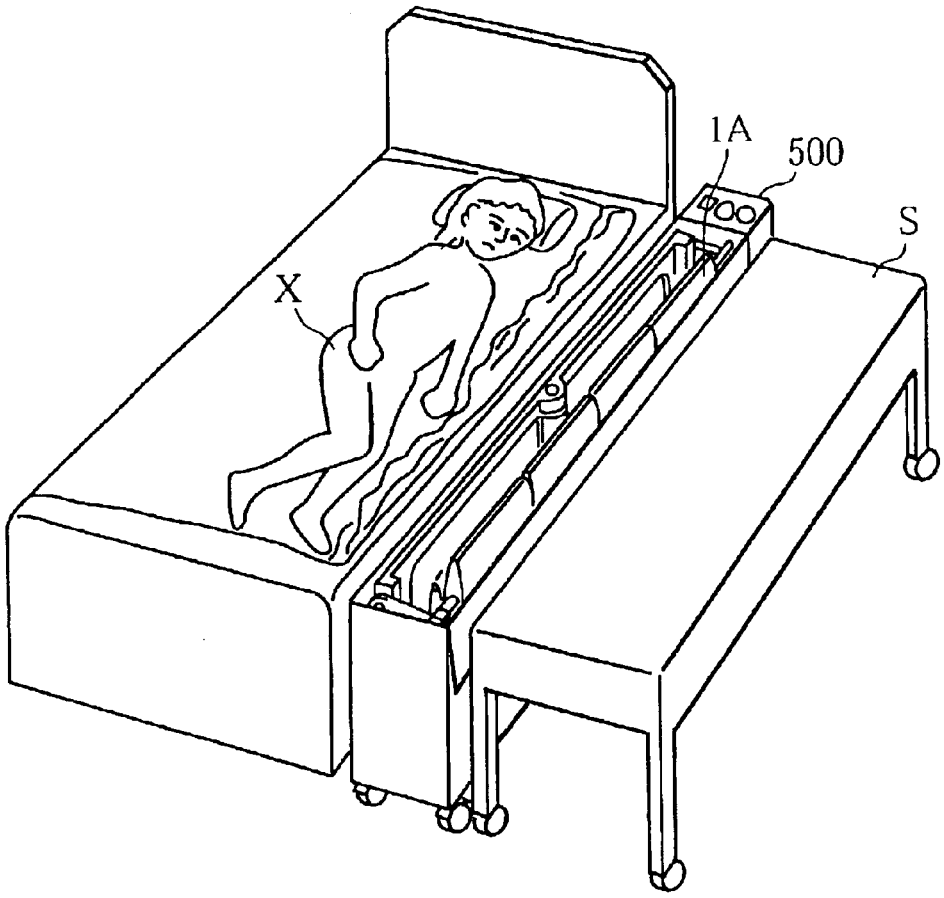
Figure 24:
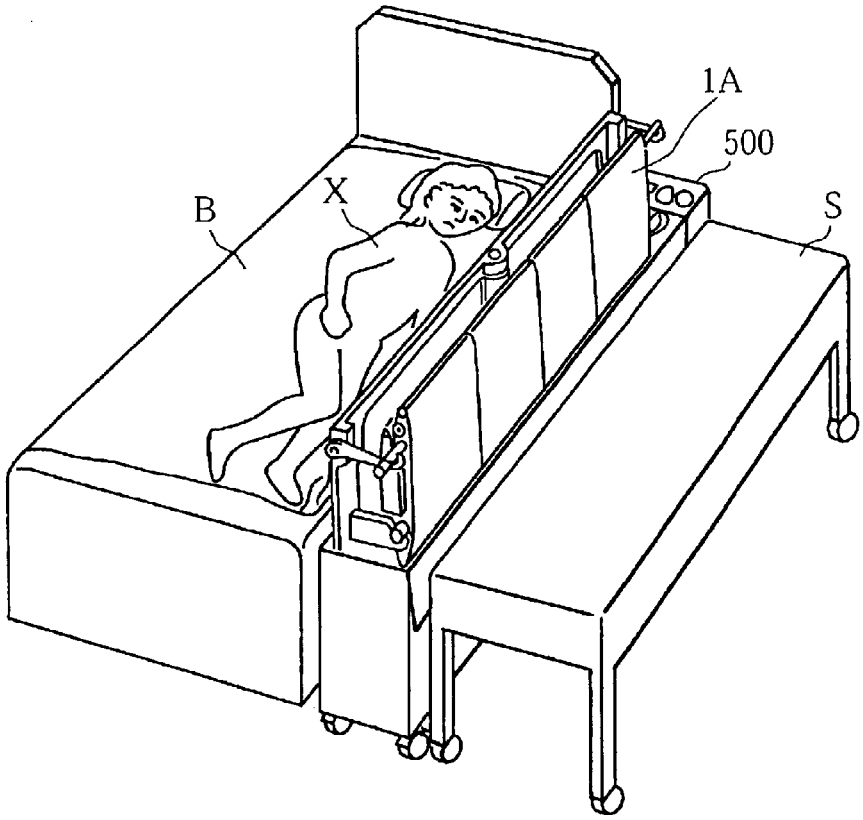
Figure 25:
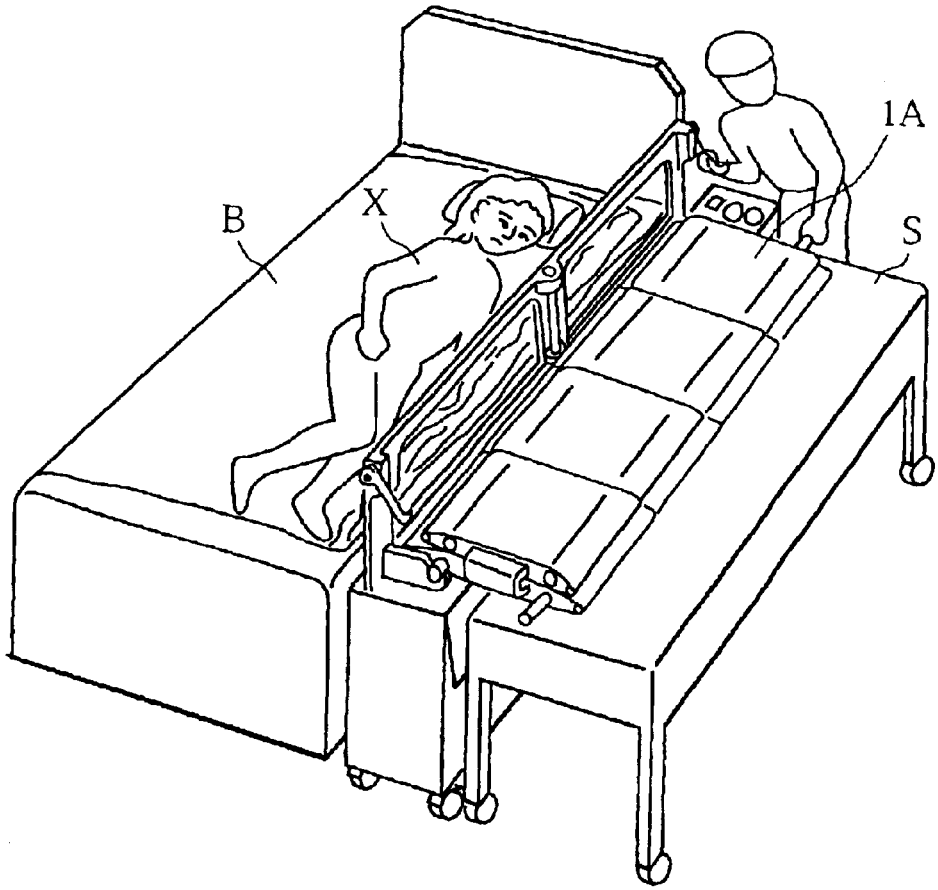
Figure 26:
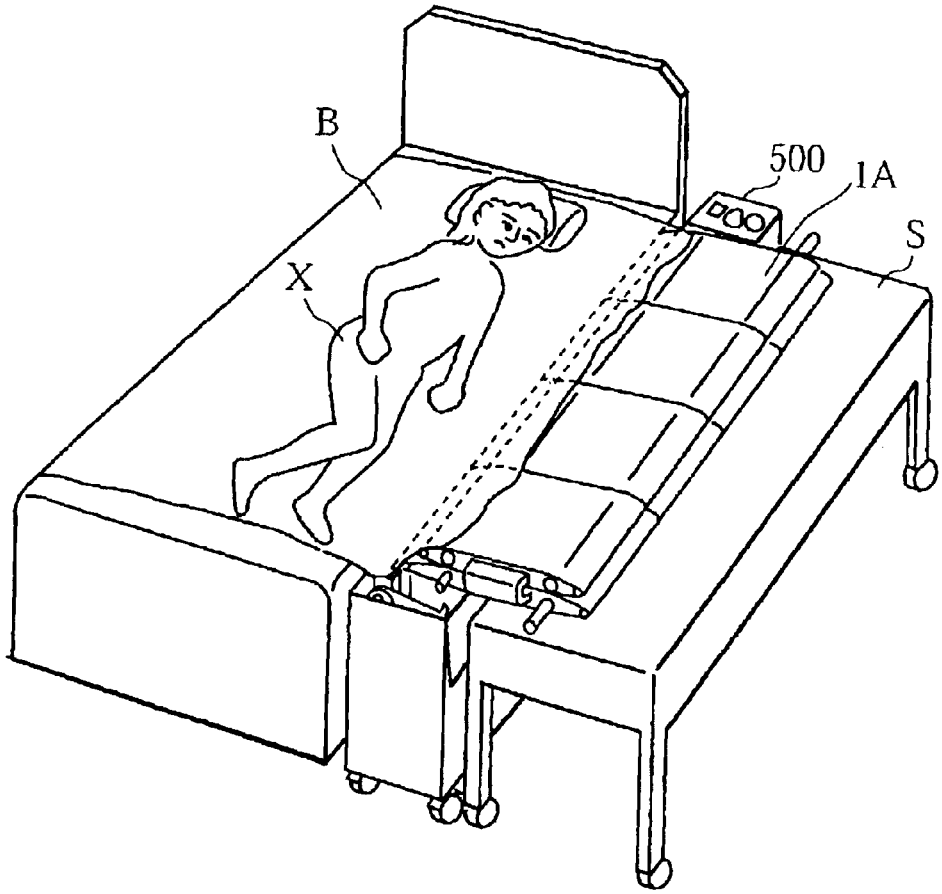
Figure 27:
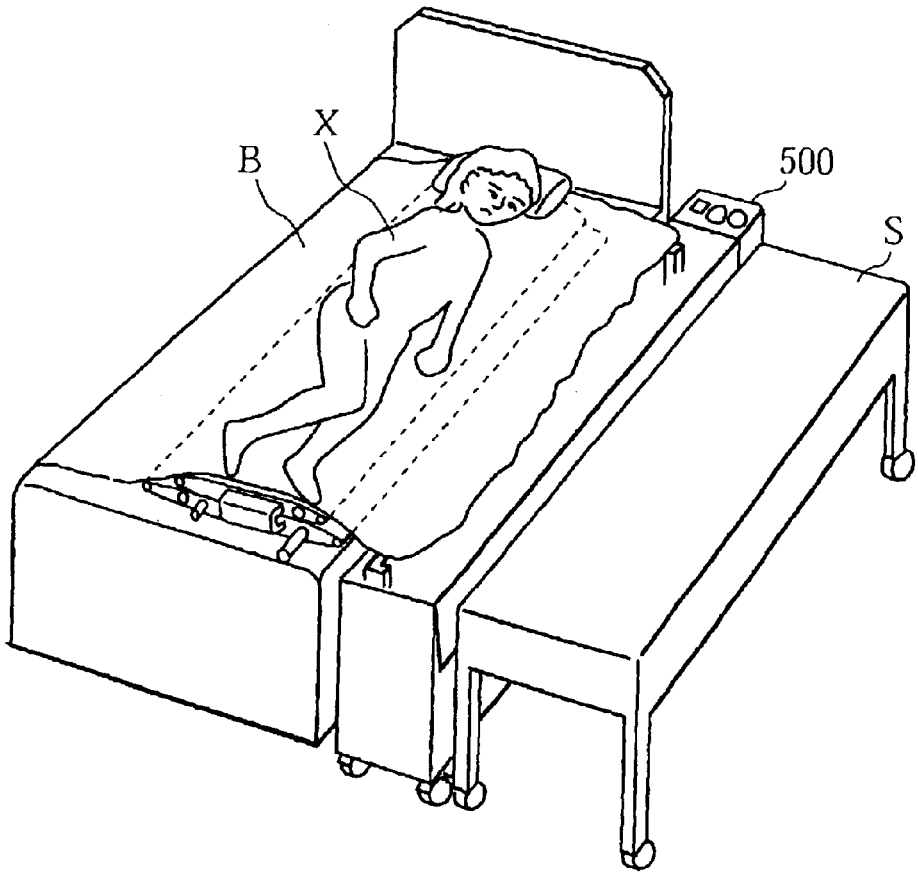

An accommodating device 500 for the transfer device assembly 1A is attached laterally at the side of the bed B (FIG. 22). The patient X lies on a sheet on the bed B. A stretcher S is positioned (FIG. 23) laterally next to the bed B, on the other side of the accommodating device 500, whose cover is opened. By pressing an operating switch of the accommodating device 500, a first lift member that is held in engagement with the transfer device assembly 1A is raised, pulling the transfer device assembly 1A out upwardly (FIG. 24). The transfer device assembly 1A is moved manually over the stretcher S (FIG. 25) and the first lift mechanism is lowered (FIG. 26). The transfer device assembly 1A is then operated as described above and self-moves towards the bed B. The transfer device assembly 1A thereby burrows between the bed B and the patient thereon, creating the condition in which the patient X is lying on the transfer device assembly 1A (FIGS. 26 and 27). One edge of the sheet may then be arranged to cover one side edge of the transfer device assembly 1A beforehand. By doing this, safety is further increased in the following operation, since there is no possibility of the transfer device assembly 1A coming into contact directly with the patient X.

Figure 28:
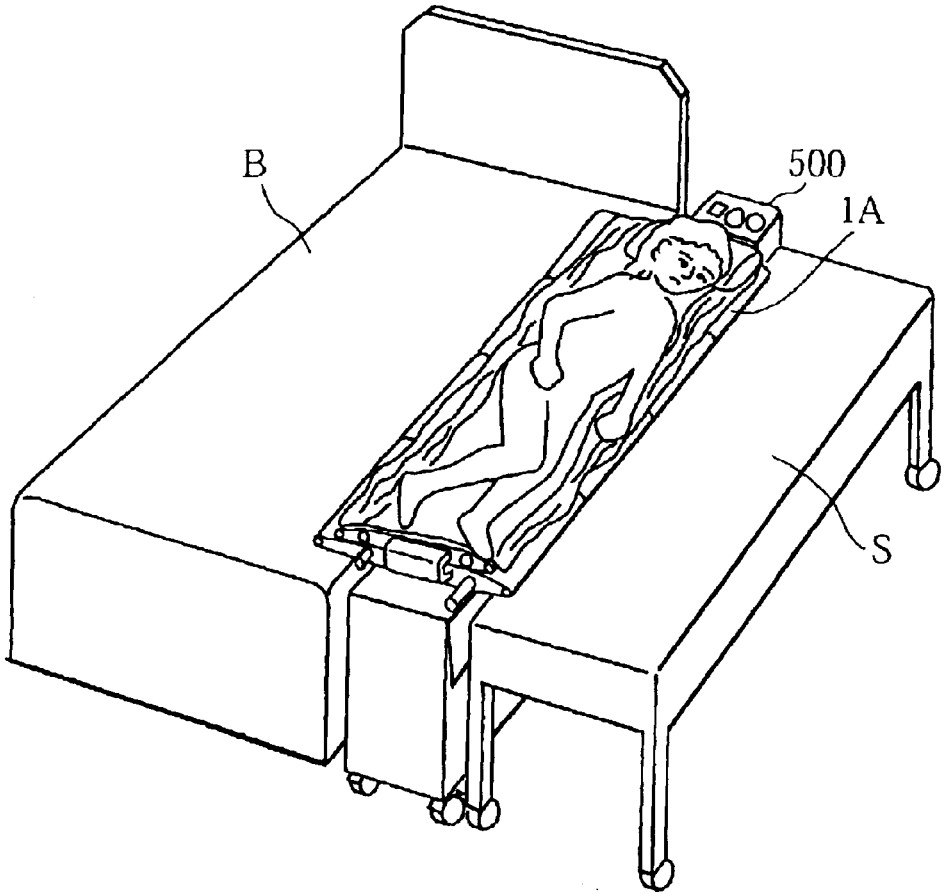
Figure 29:
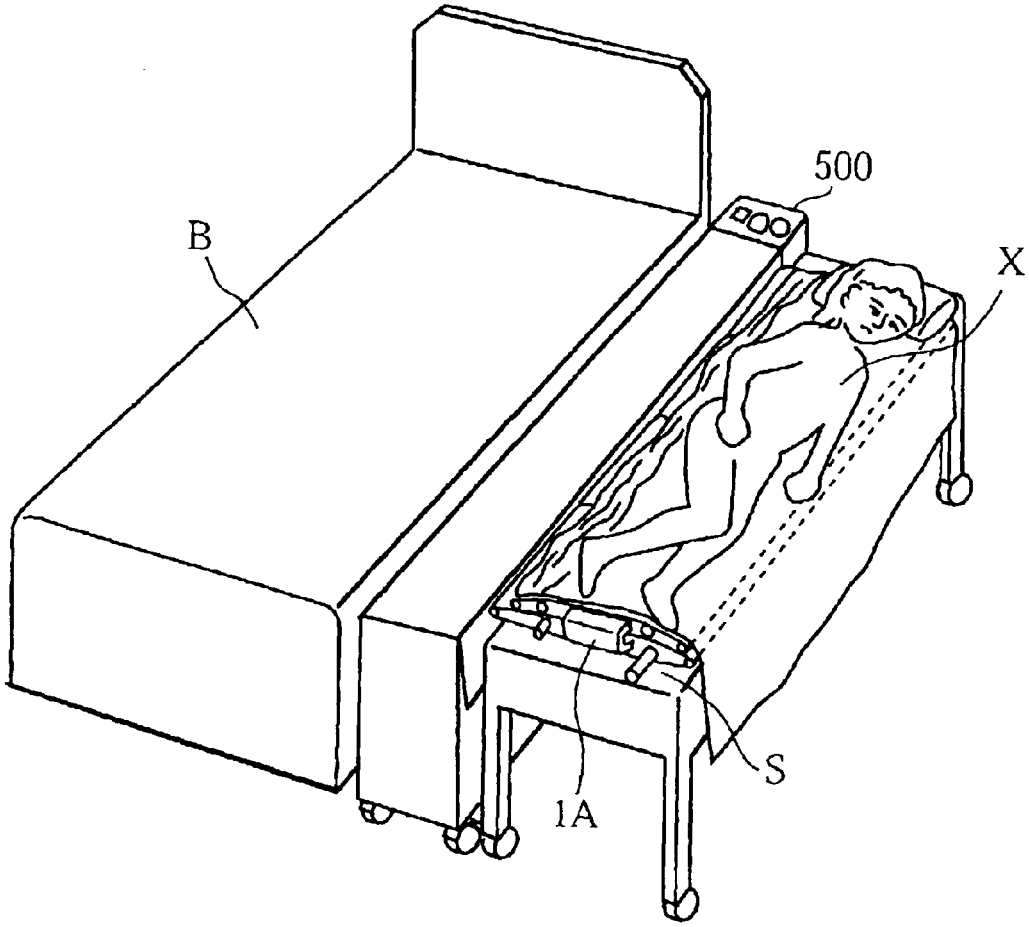
Figure 30:
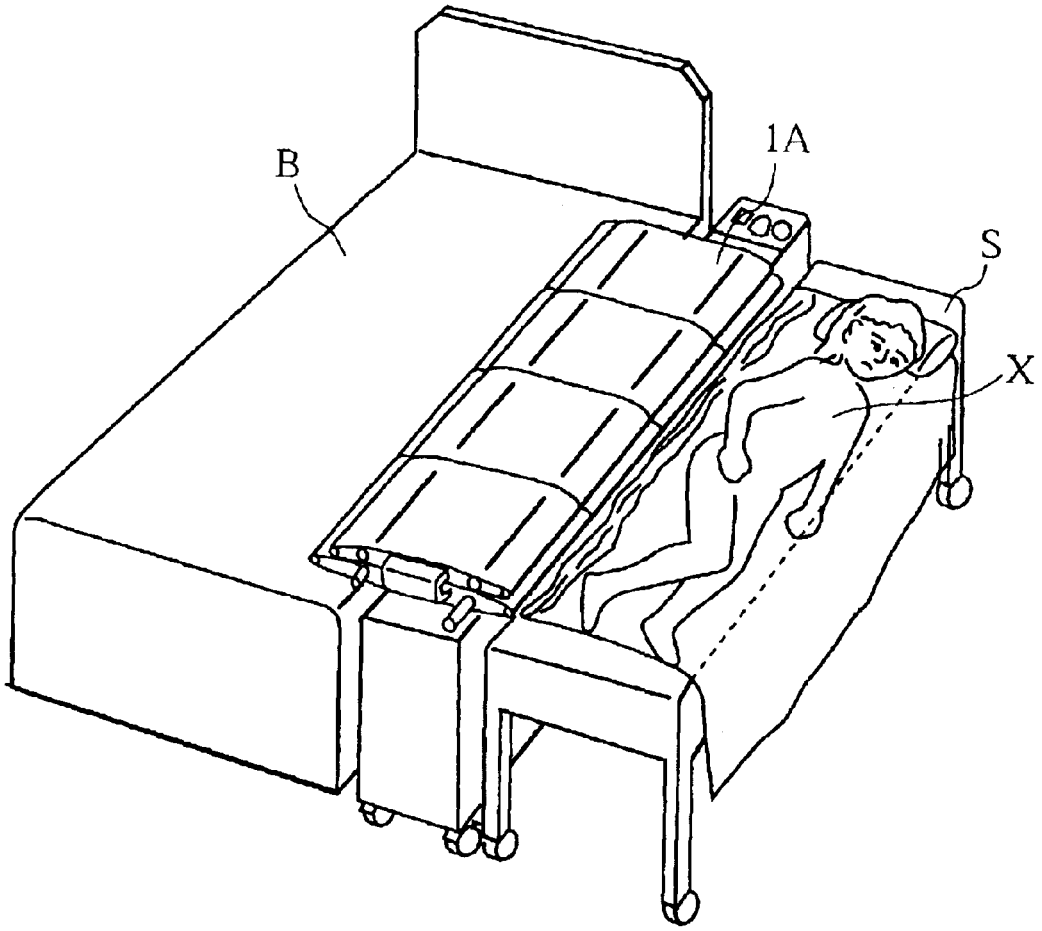
Figure 31:
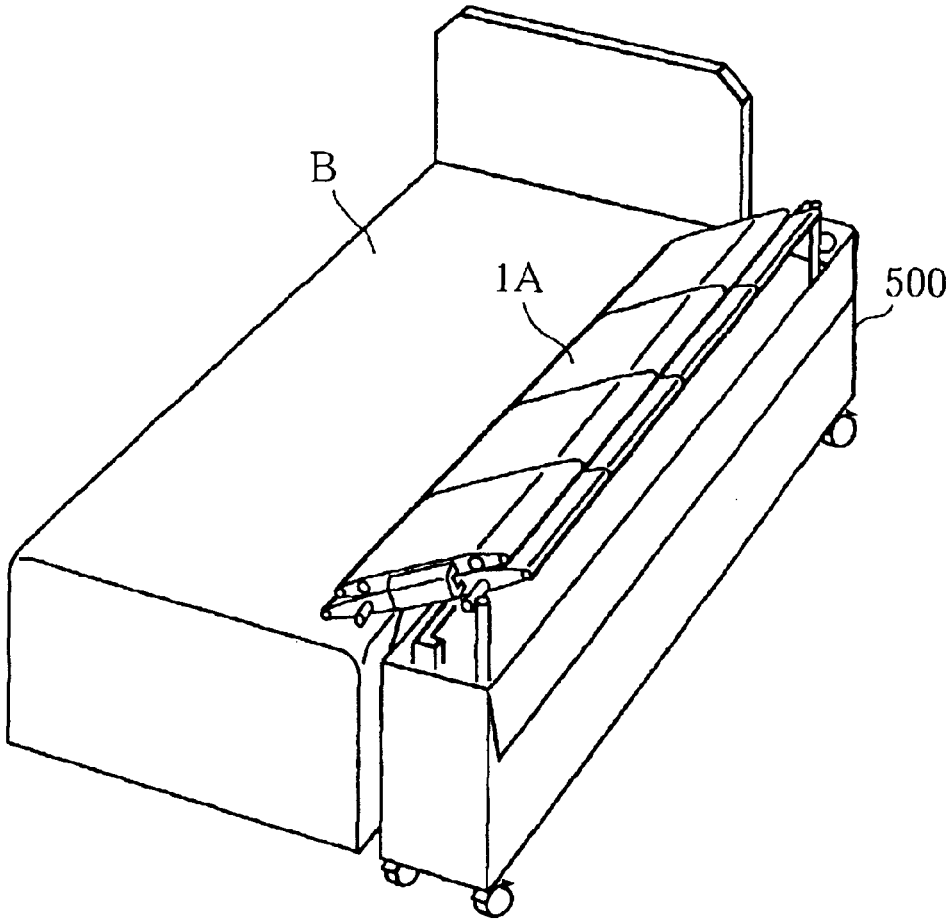

Next, the transfer device assembly 1A carrying the patient A is operated in the above-described manner to self-move to a position above the stretcher S (FIG. 28, FIG. 29).

The transfer device assembly 1A is then removed (FIG. 30) from between the patient X and the stretcher S. Transfer of the patient from the bed B onto the stretcher S is thereby completed.

Figure 32:
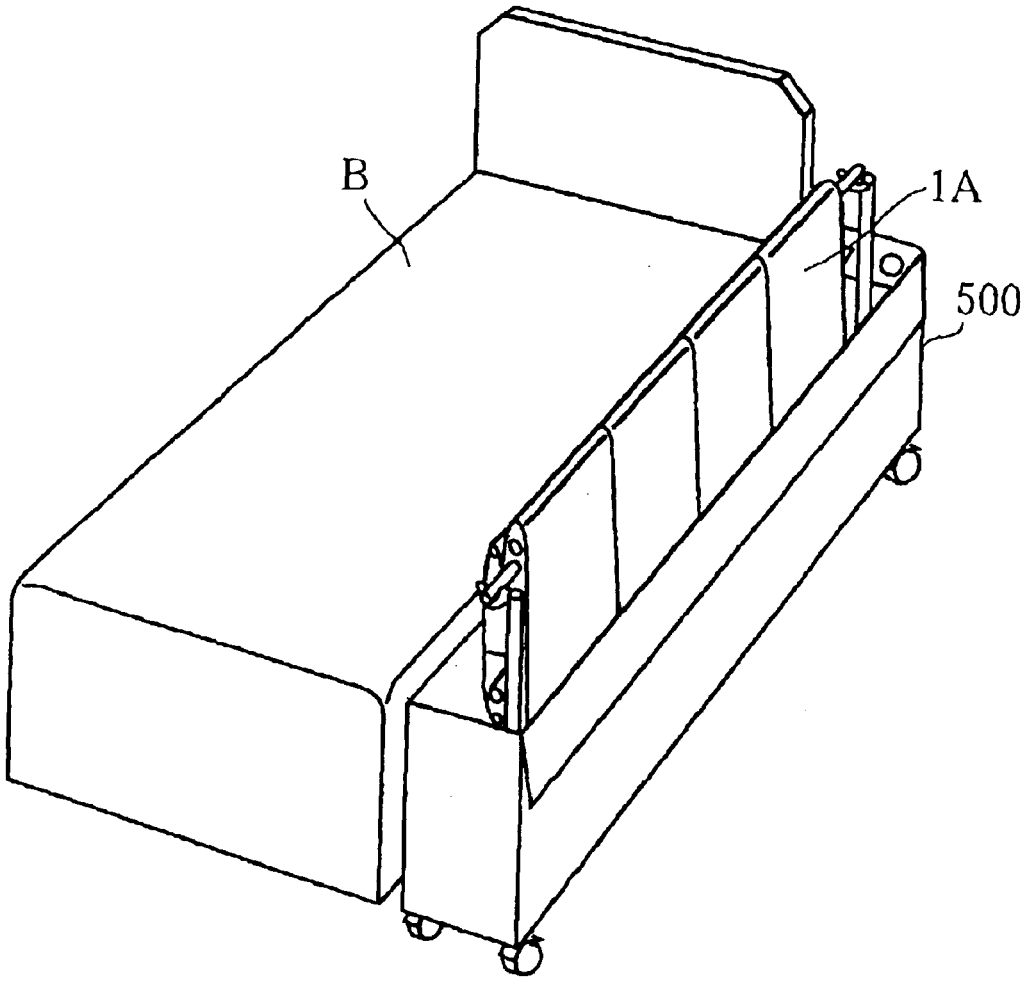
Figure 33:
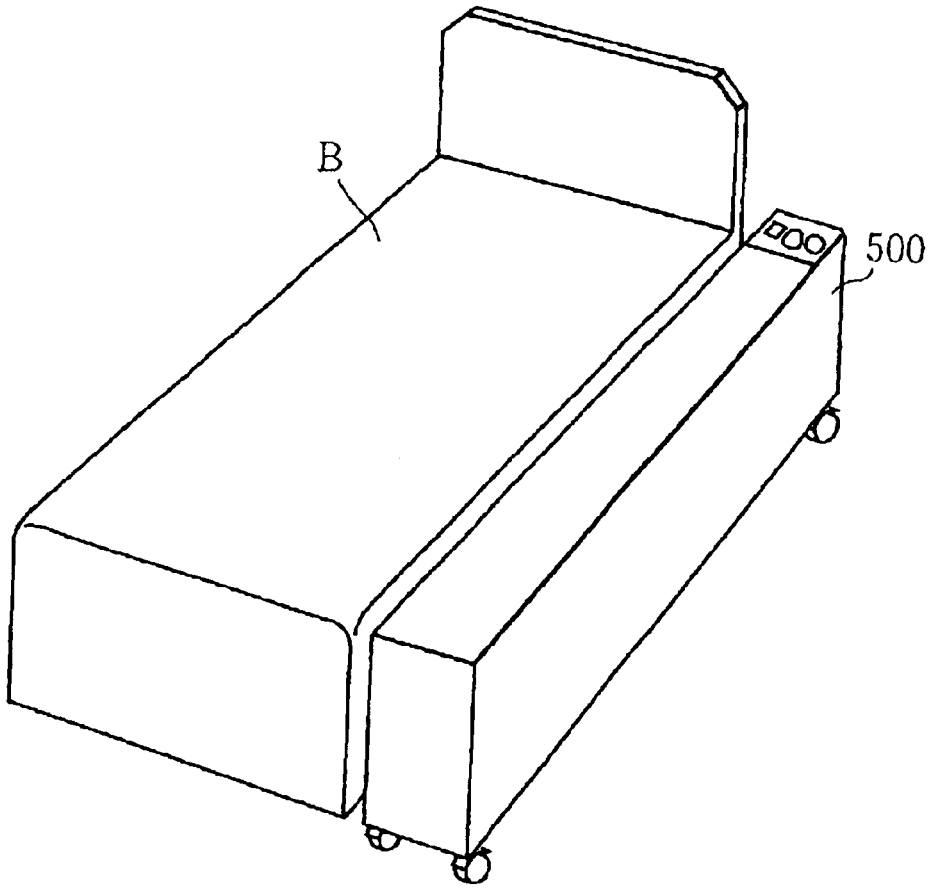

The transfer device assembly 1A, in the vicinity of the accommodating device 500, is engaged with and held by the second lift mechanism (FIG. 31) by raising of the second lift mechanism within the accommodating device 500. Then, the assembly is accommodated in the accommodating device 500 by lowering of the second lift mechanism (FIGS. 32 and 33).

It should be noted that transfer of the patient from the stretcher to the bed can be performed by the opposite procedure to that described above.

FIG. 35 to FIG. 38 show the accommodating device 500 in more detail than FIG. 22 to FIG. 33. The description is as follows.

Figure 34A:
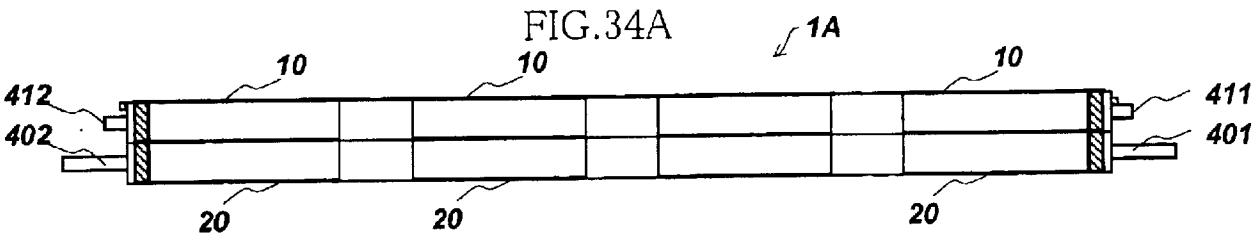
FIG. 34A is a front view.
Figure 34B:
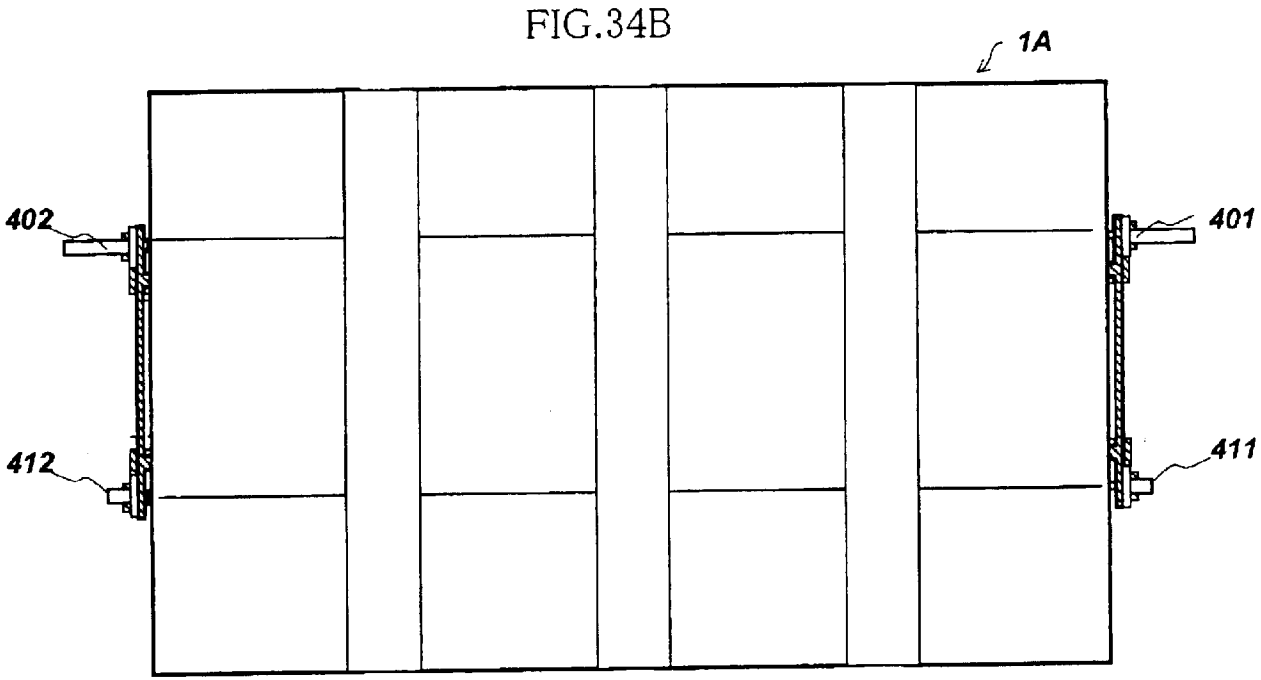
FIG. 34B is a plan view and FIG. 34C is a side view of the modified device.
Figure 34C:
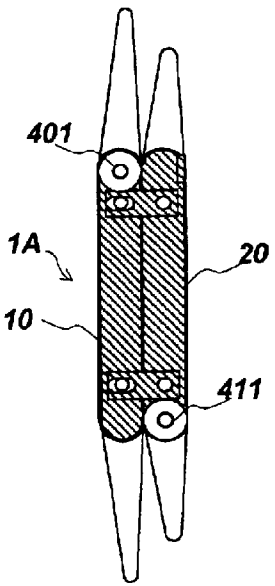
Figure 35:
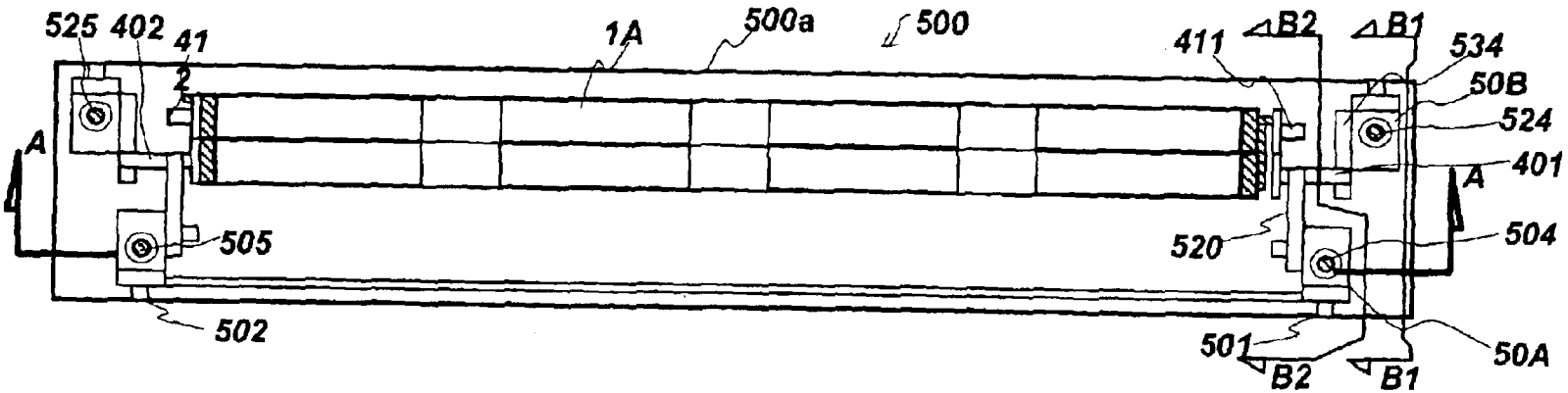
FIG. 35 is a plan view showing an accommodating device for accommodating the transfer device assembly of FIG. 34.

To utilize the accommodating device 500, as shown in FIGS. 34A~34C, two engagement rods 401, 402, 411, 412 are respectively provided at both ends of the transfer device assembly 1A. Specifically, comparatively short first engagement rods 411, 412 are provided at one end of the frame 200 of the lower mechanism 20 i.e. in a location corresponding to the position of the first main roller 124, while comparatively long, second operating rods 401, 402 are provided at the other end of the frame 100 of the upper mechanism 10 i.e. in a location corresponding to the position of the second main roller 134.

As shown in FIG. 35 to FIG. 38, the accommodating device 500 is constituted by installing two lifting mechanisms 50A, 50B within an accommodating box 500*a* provided with sufficient space to accommodate the transfer device assembly 1A in the vertical direction. The first lifting mechanism 50A comprises sliding guides 501, 502 arranged along one inside wall of the accommodating box 500*a* and sliding bodies 503 that are guided and supported so as to be capable of sliding movement in the vertical direction on these sliding guides 501, 502. These sliding guides 501, 502 are provided at both ends in the longitudinal direction of the accommodating box 500*a*. The sliding bodies 503 are arranged to be raised and lowered by feed mechanisms comprising female threaded bodies 506 that are provided below this sliding body and vertical feed screws 504, 505 capable of axially rotated drive while threaded with these female threaded bodies 506. The feed screws 504, 505 are linked with a drive motor 512 by means of bevel gear mechanisms 508, 510.

Figure 38:
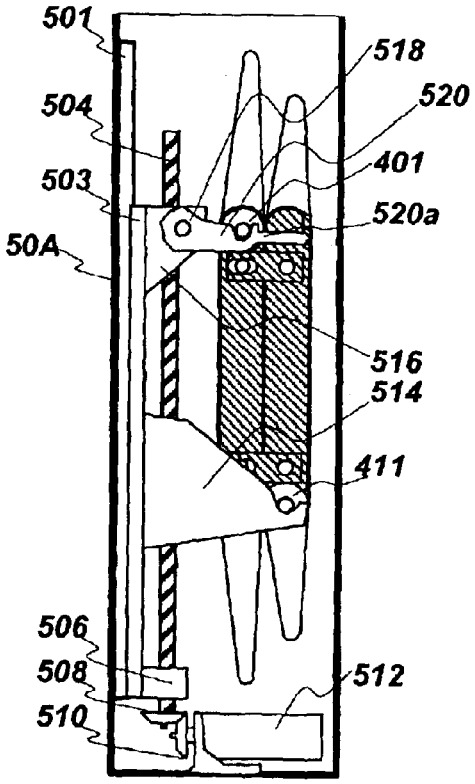
FIGS. 38~47 illustrate the operation of the accommodating device shown in FIG. 35, the view corresponding to a cross-section taken along the line B2—B2 in FIG. 35.

The upper end of the sliding body 503 supports a rotatable hook arm 520 via a bracket 503, where the hook arm is capable of engagement from below with the root of the second engagement rods 401, 402 of the transfer device assembly 1A. Preferably the hook arm 520 is provided with a certain resistance to its rotation and, as shown in FIG. 38, a handle 520*a* for convenience of manual rotation operation is formed thereon. Below the sliding bodies 503, there are also provided hooks 514 capable of supporting the first engagement rods 411, 412 of the transfer device assembly 1A from below.

The second lifting mechanism 50B is provided with sliding guides 521 arranged along the other inside wall of the accommodating box 500*a* and sliding bodies 523 that are guided and supported so as to be capable of sliding movement in the vertical direction on these sliding guides 521. These sliding guides 521 and sliding bodies 523 are provided at both ends in the longitudinal direction of the accommodating box 500*a* in the same way as in the case of the first lifting mechanism 50A. The sliding bodies 523 are arranged to be moved in the vertical direction by feed mechanisms comprising female threaded bodies 526 that are provided below this sliding body 523 and vertical feed screws 524, 525 capable of axially rotated drive while threaded with these female threaded bodies 526. The feed screws 524, 525 are linked with a drive motor 532 by means of bevel gear mechanisms 528, 530.

The upper end of the sliding body 523 of the second lifting mechanism 50B supports a hook arm 534 capable of engagement from below with the leading end of the second engagement rods 401, 402 of the transfer device assembly 1A.

Figure 37:
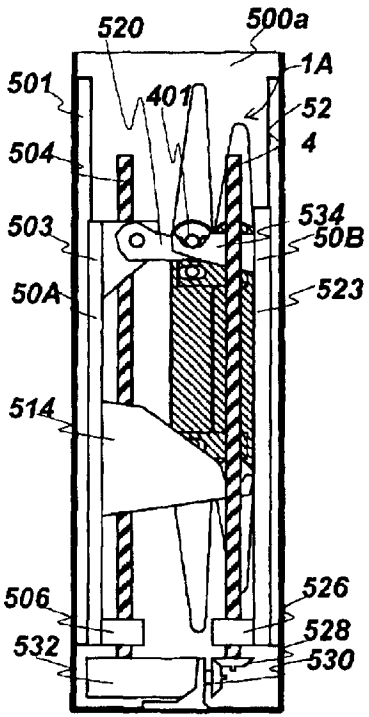
FIG. 37 is a cross-sectional view taken along the line B1—B1 in FIG. 35.
Figure 36:
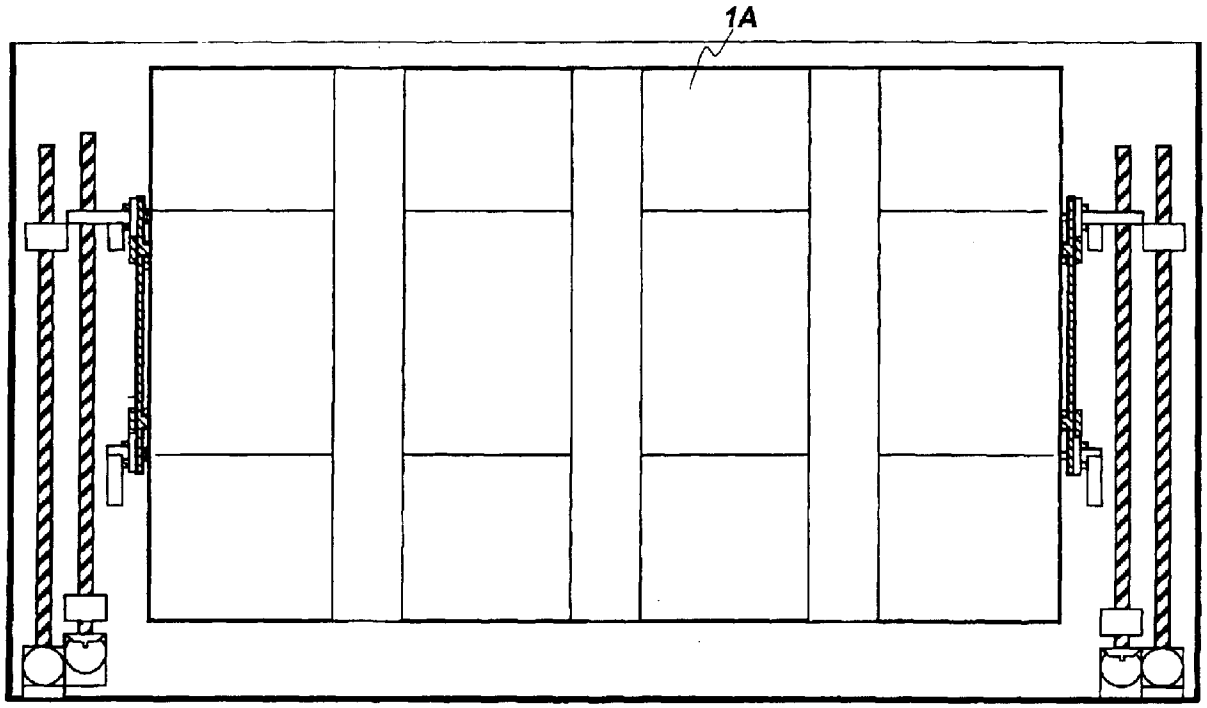
FIG. 36 is a cross-sectional view taken along the line A—A in FIG. 35.

When the transfer device assembly 1A is accommodated as shown in FIGS. 37 and 38, the first engagement rods 411, 412 of the transfer device assembly 1A are engaged such as to be placed on the hooks 514 of the first lifting mechanism 50A, while the second engagement rods 401, 402 are engaged by the hook arm 520. In this manner, the weight of the transfer device assembly 1A is supported by the hooks 514 via the first engagement rods 411, 412, and tipping over of the assembly is prevented by the hooks 520. Simultaneously, the first engagement rods 411, 412 are also made to engage with the hooks 534 of the second lifting mechanism 50B. These hooks 534 support part of the weight of the transfer device assembly 1A and prevent tipping over of the transfer device assembly 1A.

Figure 39:
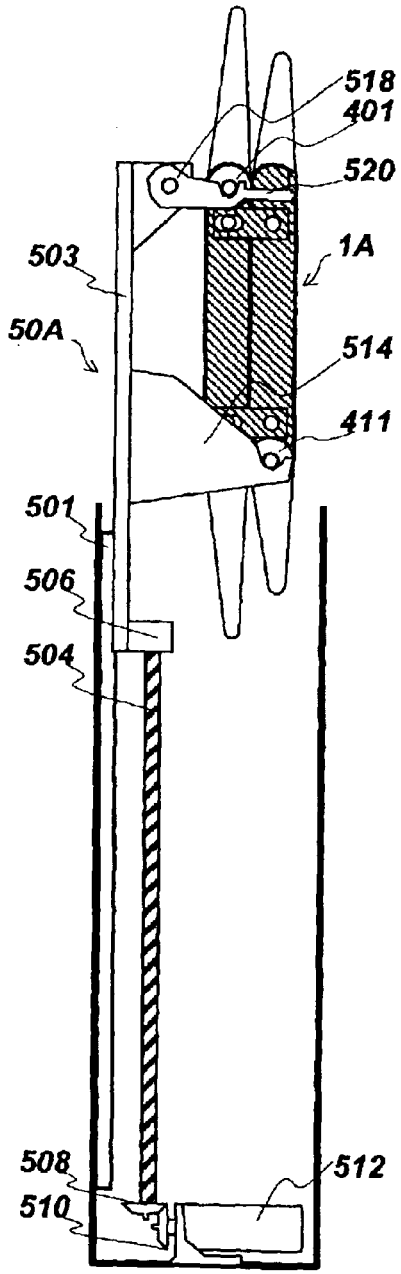
Figure 41:
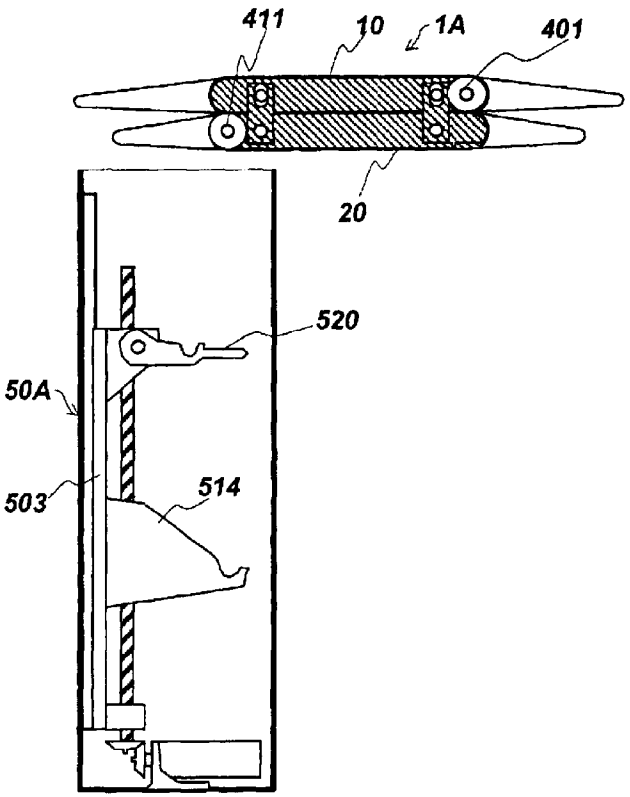
Figure 40:
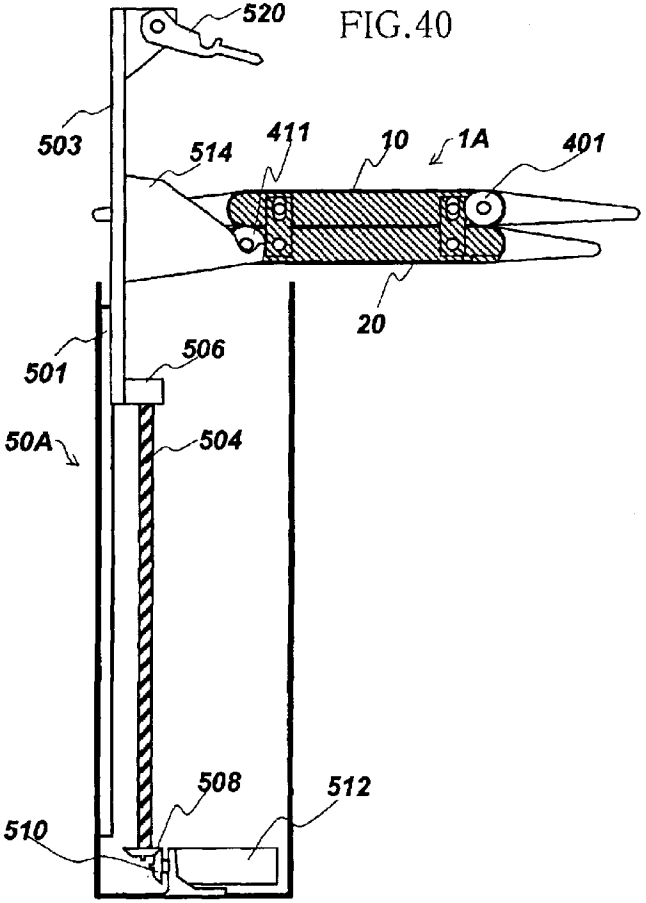

Referring to FIG. 39, when the sliding body 503 of the first lifting mechanism 50A is raised, the transfer device assembly 1A is raised in a manner such that the first engagement rods 411, 412 are maintained in a condition engaging with the lower hooks 514, and that the second engagement rods 401, 402 are maintained in a condition engaging with the upper hook arm 520. When the engagement with respect to the second engagement rods 401, 402 is released by operating the hook arm 520, as shown in FIG. 40, the transfer device assembly 1A can rotate to the horizontal condition about the first engagement rods 411, 412 carried on the lower hooks 514, whereby the transfer device assembly 1A can be put in a standby condition carried on the stretcher S, for example (FIG. 41).

Figure 43:
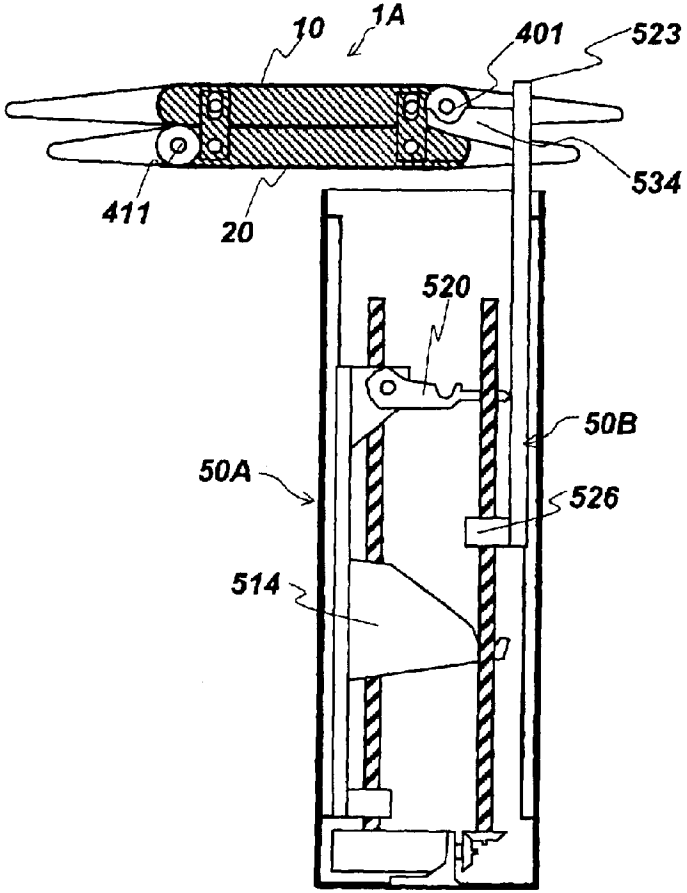
Figure 42:
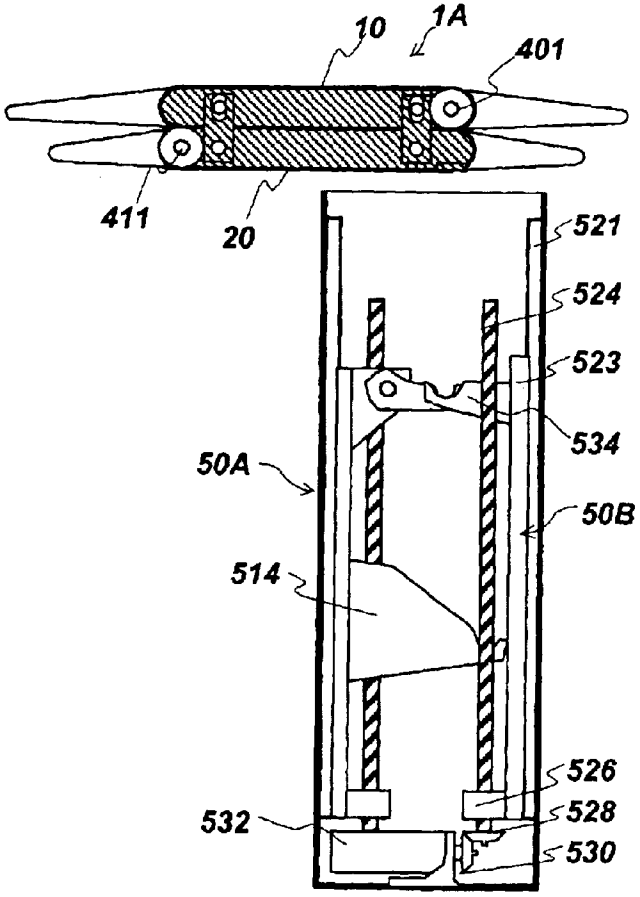
Figure 44:
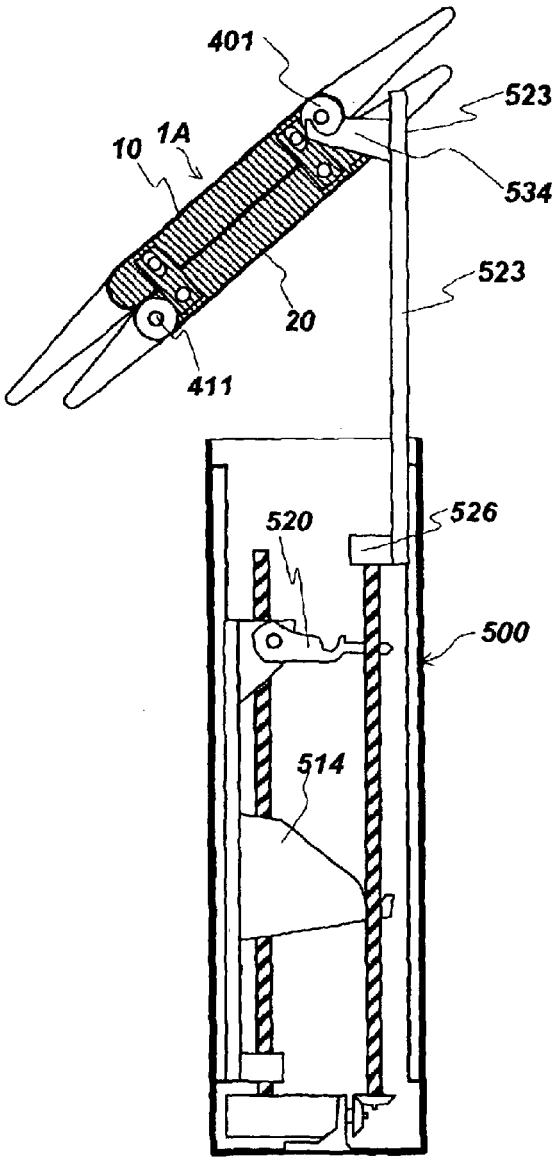
Figure 45:
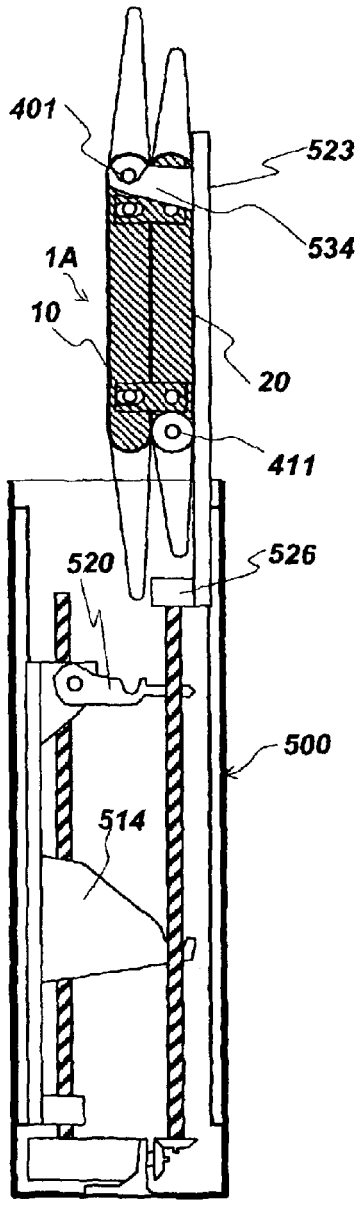

On the other hand, after transfer of a transfer subject X has been completed, as shown in FIG. 42, the second engagement rods 401, 402 of the transfer device assembly 1A are positioned exactly above the hooks 534 of the second lifting mechanism 50B. In this condition, the sliding bodies 534 of the second lifting mechanism 50B are raised. When this done, as shown in FIG. 43, the upper hooks 534 of these sliding bodies 523 engage the second engagement rods 401, 402 from below and, by further raising of the sliding bodies 523, as shown in FIG. 44 and FIG. 45, the transfer device assembly 1A is held in a suspended condition.

Figure 46:
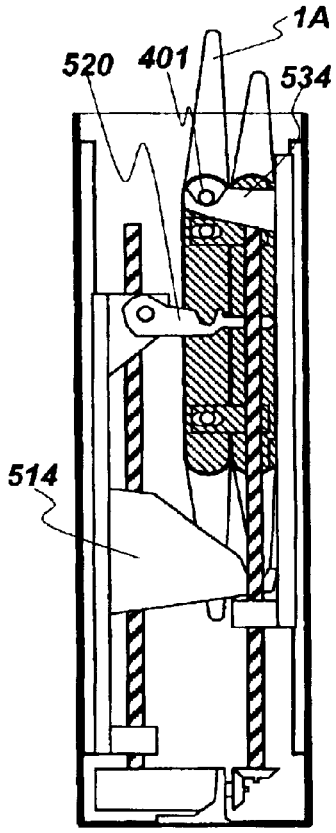
Figure 47:
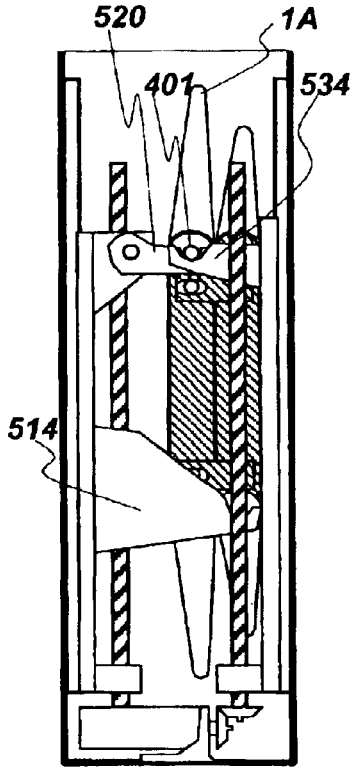

Next, as shown in FIG. 46 and FIG. 47, when the sliding bodies 523 of the second lifting mechanism 50B are lowered, the second engagement rods 401, 402 and the first engagement rods 411, 412 respectively engage the hook arm 520 of the first lifting mechanism 50A and the lower hooks 514, and the transfer device assembly 1A is thereby accommodated in the accommodating box 500*a*.

In this way, with the transfer device or a transfer device assembly constructed as above, power for raising a transfer subject such as a patient is basically unnecessary and there is no relative sliding movement of the belt and the transfer subject or the belt and the bed surface or stretcher, so power for drive purposes can be reduced to the minimum. Also, safety can be ensured since the situation of the transfer subject such as a patient being inadvertently dropped basically does not arise.

Also, the accommodating device constructed as above can accommodate the transfer device assembly and enable its removal therefrom in a convenient manner. Since the transfer device assembly can be accommodated in an upright condition, space requirements are reduced.

Of course, the scope of the present invention is not restricted to the embodiments described above and all modifications within the scope of the claims are included in the scope of the present invention.

Although in the embodiment the upper mechanism 10 and the lower mechanism 20 are assembled as identical mechanisms facing the same surface, except in regard to the lengths of the first arm 40 and the second arm 50, it is not necessary to employ identical mechanisms. The important feature is that the respective belts 101, 202 of the upper mechanism 10 and lower mechanism 20 can individually be driven in circulation in the forward and reverse directions.

Also, although, in the embodiment, it may be arranged that a contacting overlying condition and a separated condition of the upper mechanism 10 and lower mechanism 20 could be selected by an attachment/detachment mechanism employing cams 323, the two mechanisms could be linked in a fixed condition, so long as sliding in mutual contact of the belts 101, 202 of the upper mechanism 10 and lower mechanism 20 can be avoided.

Also, although, in the embodiment, the first arm 40 and the second arm 50 of the upper mechanism 10 are made longer than the first arm 40 and second arm 50 of a matter for design.

Furthermore, although, in the embodiment, the arms of the upper mechanism 10 and lower mechanism 20 are made capable of swinging with respect to the frame, fixed arms could be employed and, if need be, the arms of the lower mechanism may be dispensed with. Specifically, while the first arm 40 and second arm 50 of the upper mechanism 10 may be arranged to extend in a downwardly inclined condition from the frame such that the auxiliary rollers at their tips are positioned close to the surface of the transfer departure point or transfer destination, in the case of the lower mechanism 20, the arms and auxiliary rollers may be omitted, the belt 202 being passed between the first main roller and the second main roller.

Furthermore, although, in the embodiment, in order to reduce running friction of the belts 101 and 202 circulating around the upper mechanism 10 and lower mechanism 20, main rollers, auxiliary rollers and idler rollers are provided, if a material can be selected whereby the frictional resistance between the inside surface of the belts and the frame structural constituents can be very greatly reduced, the belts could be made to circulate by partial sliding without employing such rollers or with the number of rollers reduced.

Also, although, in the above description, a patient on a bed is envisioned as the transfer subject and a bed or stretcher is envisioned as the transfer point of departure or transfer destination, any transfer subject, transfer point of departure or transfer destination could of course be employed.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A transfer device comprising:

an upper mechanism; and a lower mechanism associated with the upper mechanism;

wherein the upper mechanism includes a first endless belt that circulates in forward and reverse directions, the lower mechanism including a second endless belt that circulates in forward and reverse directions independently of the first endless belt;

wherein each of the first and the second mechanisms comprises a frame, a first main roller rotatably supported by the frame, a second main roller rotatably supported by the frame and spaced away from the first main roller; a first arm pivotably supported by the frame, a second arm pivotably supported by the frame and positioned opposite to the first arm, a first auxiliary roller rotatably supported by an end of the first arm, and a second auxiliary roller rotatably supported by an end of the second arm; and wherein the endless belt circulates in engagement with the first main roller, the second main roller, the first auxiliary roller and the second auxiliary roller.

2. The transfer device according to claim 1, wherein the first and the second auxiliary rollers are smaller in diameter than the first and the second main rollers.

3. The transfer device according to claim 1, wherein the first and the second arms in the upper mechanism are longer than the first and the second arms in the lower mechanism.

4. The transfer device according to claim 1, further comprising a drive motor to cause the endless belt to circulate and a drive roller driven by the drive motor, wherein the drive roller is held in engagement with the endless belt.

5. The transfer device according to claim 4, further comprising a tension roller biased in a prescribed direction and held in engagement with the endless belt.

6. The transfer device according to claim 5, wherein a part of the endless belt is pulled into the frame, the pulled part being held in engagement with the drive roller and the tension roller.

7. The transfer device according to claim 1, further comprising an attachment/detachment mechanism for selectively bringing the first and the second endless belts into engagement with each other.

8. The transfer device according to claim 7, wherein the attachment/detachment mechanism comprises a pivotable cam and a cam-receiving member that the cam abuts, the cam being provided on one of the upper and the lower mechanisms, the cam-receiving member being provided on the other of the upper and the lower mechanisms.

9. The transfer device according to claim 1, wherein the frame is provided with a linking member for linking with another transfer device.

* * * * *